US011519264B1

(12) United States Patent
Han et al.

(10) Patent No.: US 11,519,264 B1
(45) Date of Patent: Dec. 6, 2022

(54) METHOD FOR OBTAINING GRAVITY COEFFICIENTS FOR ORTHOGONALLY ORIENTED ACCELEROMETER DEVICES DURING MEASUREMENT-WHILE-DRILLING OPERATIONS

(71) Applicant: CHINA PETROLEUM & CHEMICAL CORPORATION, Beijing (CN)

(72) Inventors: Jun Han, Houston, TX (US); Sheng Zhan, Houston, TX (US)

(73) Assignee: CHINA PETROLEUM & CHEMICAL CORPORATION, Beijing (CN)

( * ) Notice: Subject to any disclaimer, the term of this patent is extended or adjusted under 35 U.S.C. 154(b) by 0 days.

(21) Appl. No.: 17/454,715

(22) Filed: Nov. 12, 2021

(51) Int. Cl.

| | |
|---|---|
| ***E21B 47/022*** | (2012.01) |
| ***E21B 47/02*** | (2006.01) |
| ***G01V 3/18*** | (2006.01) |
| ***E21B 47/20*** | (2012.01) |
| ***E21B 47/135*** | (2012.01) |
| ***E21B 47/0228*** | (2012.01) |

(52) U.S. Cl.
CPC ..... *E21B 47/20* (2020.05); *E21B 47/0228* (2020.05); *E21B 47/135* (2020.05); *E21B 2200/20* (2020.05)

(58) Field of Classification Search
None
See application file for complete search history.

(56) References Cited

U.S. PATENT DOCUMENTS

| | | | | |
|---|---|---|---|---|
| 6,179,067 | B1 | 1/2001 | Brooks | |
| 6,966,211 | B2 * | 11/2005 | Wu | E21B 47/022 73/1.75 |
| 7,234,540 | B2 | 6/2007 | Estes | |
| 7,405,563 | B2 | 7/2008 | Kruspe | |
| 7,503,403 | B2 | 3/2009 | Jogi | |
| 7,623,961 | B2 | 11/2009 | Van Den Broeck | |

(Continued)

FOREIGN PATENT DOCUMENTS

WO WO-2015095180 A1 * 6/2015 ..... E21B 47/022

OTHER PUBLICATIONS

Seyed Mohsen et al.; "Auto-Calibration and Fault Detection and Isolation of Skewed Redundant Accelerometers in Measurement While Drilling Systems"; Sensors, vol. 18, Issue 702; doi:10.3390/s18030702; Published: Feb. 27, 2018.

*Primary Examiner* — Curtis A Kuntz
*Assistant Examiner* — Jerold B Murphy
(74) *Attorney, Agent, or Firm* — Novick, Kim & Lee, PLLC; Allen Xue

(57) ABSTRACT

A method for obtaining accuracy gravity coefficients out of three orthogonally oriented accelerometer devices and a thermometer by computing, using a pre-programmed micro-control unit processor, temperature errors, bias error coefficients, sensitivity error coefficients, and orthogonality error coefficients during measurement while drilling operations. Particularly, the method uses voltage data values of the three orthogonally oriented accelerometers to compute said error coefficients which provides for zero-error positioning of the MWD tool during long-term downhole surveying as well as while facing high-shock, vibrations, and high temperatures.

9 Claims, 10 Drawing Sheets

(56) References Cited

U.S. PATENT DOCUMENTS

| | | | | |
|---|---|---|---|---|
| 8,239,162 | B2 | 8/2012 | Tanenhaus | |
| 8,473,211 | B2 | 6/2013 | Cheung | |
| 8,487,626 | B2 | 6/2013 | Khan | |
| 9,512,708 | B2 | 12/2016 | Hay | |
| 9,885,232 | B2 | 2/2018 | Close | |
| 9,932,820 | B2 | 4/2018 | Sugiura | |
| 9,947,128 | B2 | 4/2018 | Korb | |
| 10,113,416 | B2 | 10/2018 | Sund | |
| 10,267,944 | B2 | 4/2019 | San Martin | |
| 10,358,913 | B2 | 7/2019 | Richards | |
| 2012/0125077 | A1* | 5/2012 | Rodney | G01C 25/00 73/1.01 |
| 2015/0027779 | A1* | 1/2015 | Sugiura | E21B 47/024 175/45 |
| 2015/0331138 | A1* | 11/2015 | Estes | G01V 13/00 324/346 |

* cited by examiner

METHOD FOR OBTAINING GRAVITY COEFFICIENTS FOR ORTHOGONALLY ORIENTED ACCELEROMETER DEVICES DURING MEASUREMENT-WHILE-DRILLING OPERATIONS

TECHNICAL FIELD

The present disclosure relates generally to methods and apparatus for determining zero-error position during directional drilling operations.

BACKGROUND OF INVENTION

1. Overview

The determination of the wellbore position is the basis for well trajectory design, monitoring, and control. The measurement error of the wellhead position, the error of well survey calculation, and the wellbore trajectory measurement error will lead to wellbore position uncertainty, being the borehole trajectory measurement error the main contributor. As such, surveying of wellbore orientation is commonly performed using measurement-while-drilling (MWD) tools containing sets of three orthogonal accelerometers, thermometers, and magnetometers that are disposed about the drill string and used to measure the orientations of the local gravitational and magnetic field vectors. To measure the earth's magnetic field, which is used as a north reference from which wellbore azimuth may be computed, these measurement-while-drilling (MWD) tools must be placed within a section of non-magnetic material extending between upper and lower ferromagnetic drillstring sections. These ferromagnetic portions of the drill string tend to acquire magnetization as they are repeatedly strained in the earth's magnetic field during drilling operations. The nominally non-magnetic portion of the drill string may also acquire some magnetization due to imperfections. The result is that magnetometer measurements made by such measurement-while-drilling (MWD) tools within a drill string may measure not the undisturbed magnetic field, but the vector sum of the earth's field and an error field caused by drill string magnetization. Since the MWD tool is affixed to the drill string, the error field is fixed with respect to the tool's coordinate system and appears as bias errors on the magnetometer measurements, which can lead to errors in the determination of wellbore azimuth and trajectory unless corrected.

On the other hand, MWD tools use redundant accelerometers based on inertial technology to improve the measuring performance of attitude, especially the measuring accuracy of roll. During drilling process, the drilling bit's acceleration and angular rotation are measured by these accelerometers, so that the position and attitude of the drilling bit are obtained and processed through a pre-programed algorithm. Nonetheless, due to accumulated drift error, the accelerometers frequently observe degradation in performance, particularly in long-term measurements. Therefore, the industry has tried to introduce the use of high-performance gyroscopes, such as fiber-optic gyroscope, but soon realized of their high cost and large size. Aiming to solve some of these problems an array of redundant accelerometers may be added to a MWD tool in hope that as one accelerometer degrades, a redundant one can be used instead. Nonetheless, what affected one accelerometer may still all accelerators, particularly when the degradation is caused by electromagnetic interference on their measuring accuracy. Therefore, the use of complicated algorithms is required to be pre-programmed into a MWD tool to obtain good performance of measuring range, measuring accuracy, anti-disturbance ability, etc.

By convention, the magnetometers and accelerometers are calibrated in a laboratory for scale factor (sensitivity error), bias (bias error), and misalignment (orthogonality error) at various temperatures within their acceptable range, and then said calibration is periodically checked at room temperature. However, while the pre-programmed calibration algorithms might work well in lab or controlled environments, they still do not account for errors (bias errors, sensitivity errors, orthogonality errors, and temperature errors) that sensors like the accelerometers suffer due to their exposure to high-temperature or high shock events during operation. Therefore, the Industry Steering Committee on Wellbore Survey Accuracy (ISCWSA) has developed error models for directional drilling systems, which have now become an industry standard. These error models are derived for two standard single station processing techniques and their values are settled with the basis in input from several service companies. Consequently, biases, scale factors, and misalignment factors of accelerometers have been successfully estimated. However, not performing auto-calibration of said sensor in drilling operations has been shown to affect the faults or errors of the accelerometers, therefore, drilling operation must be stopped. Under this scenario, the drilling device must be removed from the well and a newly calibrated MWD be immediately deployed into the well. This operation will stop the production process, causing loss of the well, and increase production costs. As such, the industry has move to auto-calibration of three orthogonal accelerometers during drilling operations, using a general approach such as the use of a gravitational acceleration vector for the Earth with nonlinear optimization methods. The main idea behind such common approach is that the orthogonal accelerometer structure is considered in most existing studies and so is their use of gravitational force. Nonetheless, other values can also be obtained from accelerometers (e.g., voltage) and used to auto-calibrate bias errors, sensitivity errors, and orthogonality errors at known temperatures, none of which have been proposed to-date.

SUMMARY OF THE INVENTION

With the broad application of complex structure wells such as cluster wells, double horizontal wells, connected wells and relief wells, it is increasingly necessary to reduce well trajectory measurement errors or describe well trajectory measurement errors accurately. However, none of the methods previously described can obtain an effective data fusion between temperature and accelerometer. Therefore, the present disclosure provides redundant accelerometers voltage measurements in a drilling measurement system that performs auto-calibration process and fault diagnosis. The use of voltage in these redundant accelerometer sensors improves the reliability and accuracy of the navigation system for the drilling system.

Particularly, in downhole drilling, the readings from the thermometers or temperature sensors and the temperature values are not always linear, especially after temperatures higher than 175 degrees Celsius. To reduce the temperature errors, certain calibration is done first, wherein measurements of said thermometers are obtained and then averaged against actual temperature readings from a series of other thermometers. This computational process is done with the onboard micro-control unit processor of the MWD tool and provides for the first step in the auto-calibration method to correct the temperature error. The temperature values obtained are then stored in the onboard memory resource.

Thereafter, using three orthogonally placed accelerometers (x', y', and z') within the MWD tool, voltage readings are acquired at different positions. Particularly, each accelerometer acquires voltage readings when they are pointing upwards as well as downwards, as well as when rotated at 90-degree circular angle intervals around the plumb line of the MWD tool. The upwards and downwards positioning of the accelerometers as well as their rotation in 90-degree is done through the control unit of the MWD tool. These movements of the accelerometers cause the acquisition of an array of voltage readings at 24 different positions per each accelerometer. In other words, accelerometer x' acquires voltage readings when itself is in the upward and downward positions a total of 8 times, but it also acquires voltage readings when the other two accelerometers y'and z' are also in the upward and downward positions, as well as at each 90-degree angle interval rotation (3 accelerometers by 2 positions by 4 90-degree angle interval rotations, totaling 24 different positions by accelerometer). Because multiple voltage readings (n) are acquired by each accelerometer, a computational average (M) is to be computed first, by the on-board micro-control unit processor which is pre-programed with algorithms. Then, said computational averages are stored to the onboard memory resource by the pre-programmed micro-control unit processor. A further computational step is required to be performed by the pre-programmed micro-control unit processor. In this step, the pre-programmed micro-control unit processor computes the average voltage values (P) at 6 different positions per accelerometer (e.g., for x' when, x' is up, y' is down, y' is up, z' is down, z' is up, z' is down), using only 4 values of M at each of the aforementioned 6 different positions.

Once all the temperature and voltage data has been acquired and computed, the micro-control unit processor, which is pre-programmed with three bias error coefficient algorithms ($V_{x'b}$, $V_{y'b}$, and $V_{z'b}$), computes said bias error coefficients using the voltage values (P) at the 6 different positions per accelerometer. These bias error coefficients are then stored in the onboard memory resource and used by the micro-control unit processor when computing sensitivity error coefficients ($S_{x'x}$, $S_{y'x}$, $S_{z'x}$, $S_{x'y}$, $S_{y'x}$, $S_{z'y}$, $S_{x'z}$, $S_{y'z}$ and $S_{z'z}$). The sensitivity error coefficients for each accelerometer are then averaged ($S_{x'}$, $S_{y'}$, and $S_{z'}$) using a pre-programmed algorithm in the micro-control unit processor and stored in the onboard memory resource. The sensitivity error coefficients are used to compute, according to a pre-programmed algorithm in the micro-control unit processor, a sets of orthogonality error coefficients for the three orthogonally oriented accelerometer devices (cos(x',x), cos (y',y), and cos(z',z)). These sets of orthogonality error coefficients are then stored to the onboard memory resource for further processing. As the drilling process occurs sub-surface, the MWD tool uses the stored bias error coefficients, the stored sensitivity error coefficients, the stored orthogonality error coefficients, with some live data acquired while drilling (e.g., sub-surface temperature and voltage values) to compute, using a pre-programmed algorithm embedded in the micro-control unit processor, an accuracy gravity coefficient for the three orthogonally oriented accelerometer devices. These steps are repeated constantly throughout the sub-surface drilling process, then stored and/or sent to an above-surface computation device that uses said accuracy gravity coefficients to accurately direct and position the deployed drill string. Nonetheless, further details, examples and aspects of the invention will be described below referring to the drawings listed in the following.

BRIEF DESCRIPTION OF THE DRAWINGS

The teachings of the present invention can be readily understood by considering the following description in conjunction with the accompanying drawings.

DETAILED DESCRIPTION OF THE INVENTION

Reference will now be made in detail, to several embodiments of the present disclosures, examples of which, are illustrated in the accompanying figures. It is noted that wherever practicable similar or like reference symbols may be used in the figures and may indicate similar or like functionality. The figures depict embodiments of the present disclosure, for purposes of illustration only. One skilled in the art will readily recognize from the following description that alternative embodiments of the structures, systems, and methods illustrated therein may be employed without departing from the principles of the disclosure described herein.

Figure 1:
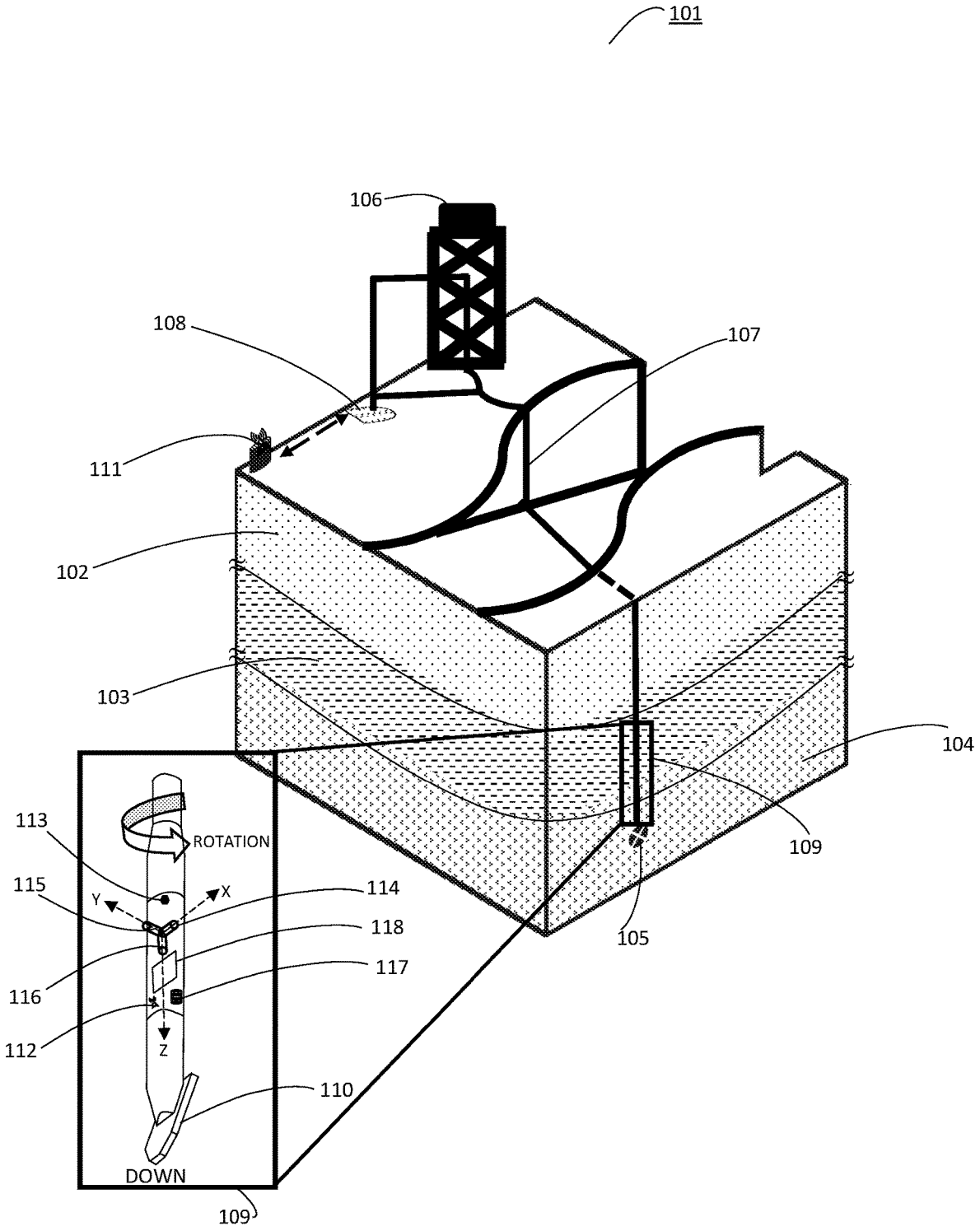
FIG. 1 illustrates a drilling system showing a cross sectional view of the MWD tool with the respective placement of the three orthogonally oriented accelerometers, according to certain embodiments of the present disclosure.

In FIG. 1 a cross-sectional view of a portion of the earth over survey region 101 is illustrated, showing different types of earth formation, 102, 103, and 104, for purposes of fully enabling persons skilled in the art to understand the present invention.

As used herein the term "survey region" refers to an area or volume of geologic interest, and may be associated with the geometry, attitude and arrangement of the area or volume at any measurement scale. A region may have characteristics such as folding, faulting, cooling, unloading, and/or fracturing that has occurred therein.

FIG. 1 shows a well location 105, an oil well site 106 attached to a borehole 107 through a drill string, along which multiple measurements are obtained using techniques known in the art. This borehole 107 is used to obtain well log data that includes P-wave velocity, S-wave velocity, density, among others. Other sensors, not depicted in FIG. 1, are also placed within the survey region to capture other data information required to perform various geophysical analysis. Furthermore, drilling fluid or mud stored in pit 108 is formed at the well site 106 in the survey region 101 and sent through the mud channel of the borehole 107 to lubricate the drill bit 110 and to carry formation cuttings up to the surface as it is returned to pit 108 for recirculation. The measurement data can also be transmitted using mud pulses that travel to and decoded by sensors near or at surface, e.g., mud pulse telemetry. The data points are then stored in an above-surface memory resource 111. Nonetheless, persons skilled in the art will also understand that these data points can be transmitted wirelessly (illustrated with a broken line arrow) to the above-surface memory resource 111 using an embedded telemetry device 112 within the MWD tool 109. These data points, particularly temperature data points (t) acquired by the MWD's tool 109 temperature sensor 113 and sub-surface voltage data points ($V_{x'm}$, $V_{y'm}$, and $V_{z'm}$) are acquired by a first (x') 114, a second (y') 115, and a third (z') 116 of three orthogonally oriented accelerometer devices that are all first stored on the MWD's tool 109 local memory resource 117. Thermometer 113, accelerometers 114, 115, and 116, as well as telemetry device 113 and memory resource 117 are all coupled to a pre-programmed micro-control unit processor 118 that is used to compute certain preprogramed algorithmic expressions (e.g., bias coefficient errors, sensitivity coefficient errors, orthogonality error coefficient, accuracy gravity coefficient) that combined are used to guide the direction of the borehole 107 in real time. Of further importance, the pre-programmed micro-control unit processor 118 generally disposed near the drill bit with capabilities for measuring, processing, computing, generating, and storing information, as well as wirelessly or wired communicating with the embedded telemetry device 112 for further processing.

As illustrated in FIG. 1, the MWD tool 109 is currently in its downward position with the third (z') 116 of three orthogonally oriented accelerometer devices also facing downward. Nonetheless, the MWD tool 109 can be easily inverted upside down, making the third (z') 116 of three orthogonally oriented accelerometer devices point upward. Similarly, it is illustrated the rotational direction of MWD tool 109 which, for purposes of this invention, is done in 90 degrees increment, being the first position, it is starting rotation or rotating angle of 0 degrees. Therefore, the MWD tool 109 rotates a total of 4 times comprising angle increments 90, 180, 270, and then back to its starting angle. Furthermore, since each of the three accelerometers have been orthogonally oriented within the MWD tool 109, they are also shown with their respective axis, being the first accelerometer 114 placed on the x-axis, the second accelerometer 115 placed on the y-axis, and the third accelerometer 116 placed on the z-axis.

Figure 2:
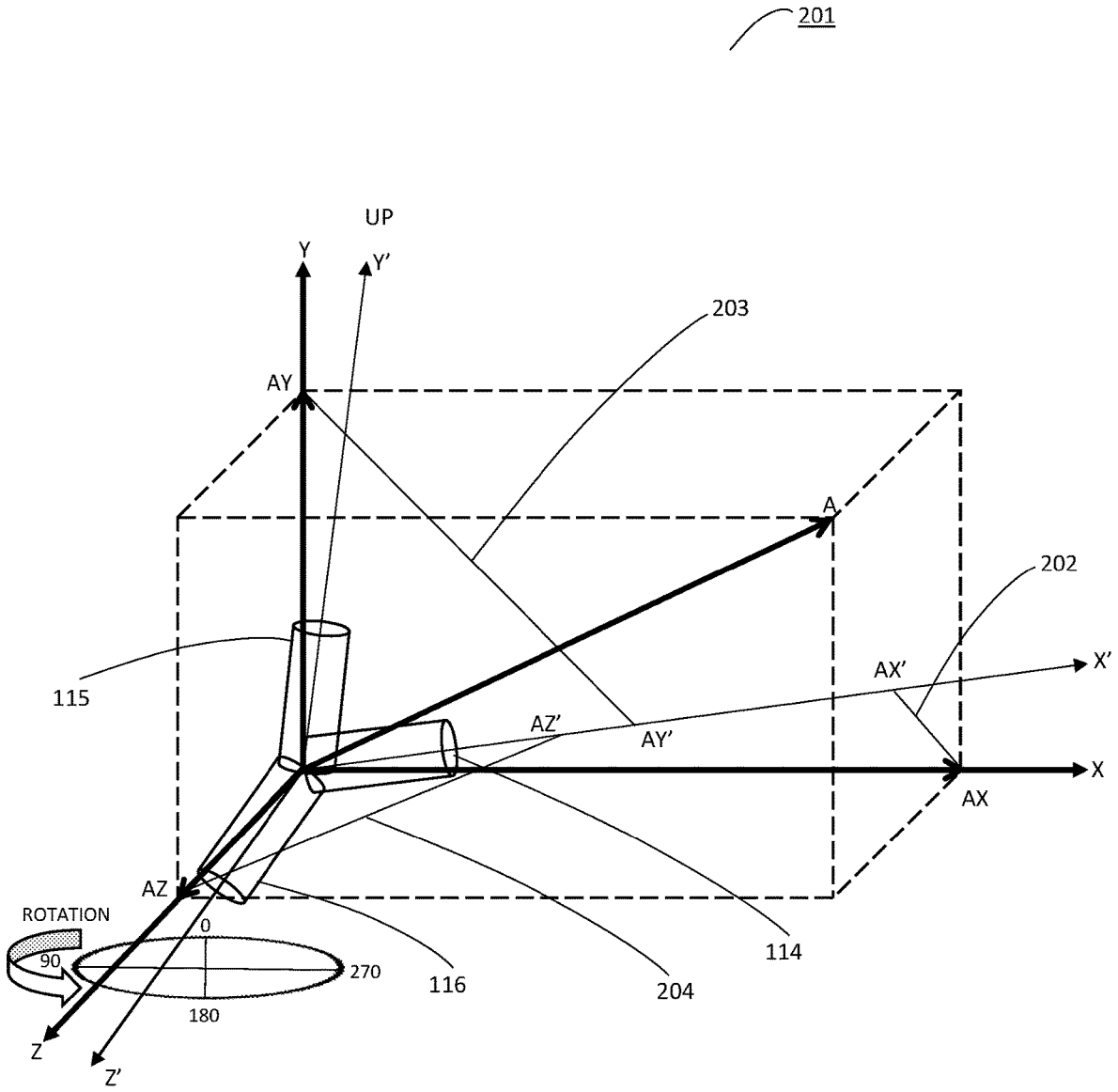
FIG. 2 graphically represents the three orthogonally oriented accelerometers in their respective axis, the upward and downward position, as well as their ideal coordinate system, according to an embodiment of the present disclosure.

Turning over to FIG. 2, 201 illustrates the three orthogonally oriented accelerometers in their respective axis, the upward and downward positions, as well as their ideal coordinate system represented by the x-axis, the y-axis, and the z-axis, as well as the actual coordinate system represented by the x'-axis, the y'-axis, and the z'-axis, according to an embodiment of the present disclosure. The difference between ideal versus the actual coordinate systems is caused by what is referred to in the art as the orthogonality error due to the fact that the measuring axis of the sensors may not be completely orthogonal during their installation in the MWD tool 109 or during their manufacturing. In 201, a random measuring point A is chosen, therefore creating vector OA. The projection of said vector onto the ideal axis would therefore create an ideal accuracy gravity coefficient vector at each axis, represented by AX, AY, and AZ Nonetheless, because of the aforementioned limitation of accelerometers, further calculation must be done in order to project vector OA to the actual axis. Therefore, the project of vector OA to say, x'-axis, would be the result of the project of AX on x', plus the projection of AY on x', plus the project of AZ on x'; as shown by lines 202, 203, and 204. This can also be illustrated using the following expression:

$$AX'=AX_x+AY_x+AZ_{x'}=AX\cos(x',x)+AY\cos(x',y)+AZ\cos(x',z) \quad (1).$$

In 201, second accelerometer device 115 is positioned upward for illustration purposes. The rotation, as previously mentioned, happens in 90 degree increments around what's recognized in the art as the plumb line—in this case position over the z'-axis. Considering that the three orthogonally placed accelerometers can each be positioned upwards or downwards (i.e., first (x') up, first (x') down, second (y') up, second (y') down, third (z') up, and third (z') down), there are total of 6 positions. Furthermore, as each accelerometer is rotated in a circle in 90 degrees increments, there would a total of 24 acquired voltage data points per accelerometer device. For avoidance of doubt, Table 1 below illustrates the 24 voltage data points acquired by the first x' accelerometer at all different positions and at the four different angles. Similarly, a table for the second (y') and the third (z') is constructed (Table 2 and 3 respectively), all showing the 24 acquired voltage data points.

TABLE 1

(acquiring voltage data points by first x' accelerometer at different positions and angles)

| When | 0-degree | 90-degree | 180-degree | 270-degree |
|---|---|---|---|---|
| first (x') up | 1 | 2 | 3 | 4 |
| first (x') down | 5 | 6 | 7 | 8 |
| second (y') up | 9 | 10 | 11 | 12 |
| second (y') down | 13 | 14 | 15 | 16 |
| third (z') up | 17 | 18 | 19 | 20 |
| third (z') down | 21 | 22 | 23 | 24 |

TABLE 2

(acquiring voltage data points by second y' accelerometer at different positions and angles)

| When | 0-degree | 90-degree | 180-degree | 270-degree |
|---|---|---|---|---|
| first (x') up | 1 | 2 | 3 | 4 |
| first (x') down | 5 | 6 | 7 | 8 |
| second (y') up | 9 | 10 | 11 | 12 |

TABLE 2-continued

| (acquiring voltage data points by second y' accelerometer at different positions and angles) | | | | |
|---|---|---|---|---|
| When | 0-degree | 90-degree | 180-degree | 270-degree |
| second (y') down | 13 | 14 | 15 | 16 |
| third (z') up | 17 | 18 | 19 | 20 |
| third (z') down | 21 | 22 | 23 | 24 |

TABLE 3

| (acquiring voltage data points by third z accelerometer at different positions and angles) | | | | |
|---|---|---|---|---|
| When | 0-degree | 90-degree | 180-degree | 270-degree |
| first (x') up | 1 | 2 | 3 | 4 |
| first (x') down | 5 | 6 | 7 | 8 |
| second (y') up | 9 | 10 | 11 | 12 |
| second (y') down | 13 | 14 | 15 | 16 |
| third (z') up | 17 | 18 | 19 | 20 |
| third (z') down | 21 | 22 | 23 | 24 |

Figure 3:
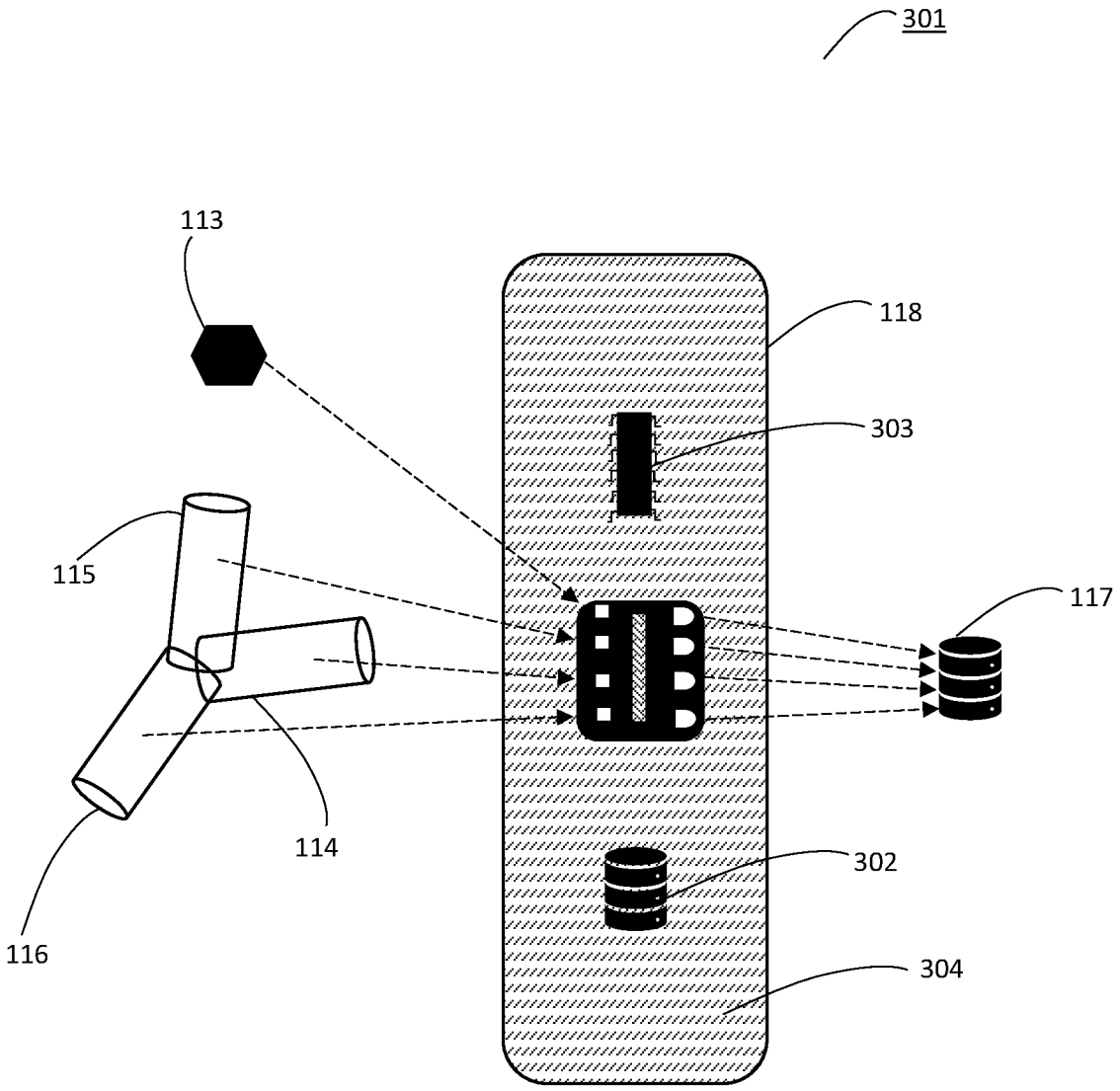
FIG. 3 is a high-level electric diagram in block form of the micro-control unit processor programmed to perform the method of obtaining accuracy gravity coefficients for the three orthogonally oriented accelerometer devices using temperature errors, bias error coefficients, sensitivity error coefficients, and orthogonality error coefficients during measurement while drilling operations, according to an embodiment of the present disclosure.

As it pertains to FIG. 3, a high-level electric diagram, in block form of the micro-control unit processor pre-programmed to perform the method of obtaining accuracy gravity coefficients for the three orthogonally oriented accelerometer devices using temperature errors, bias error coefficients, sensitivity error coefficients, and orthogonality error coefficients during measurement while drilling operations, is illustrated as 118. The micro-control unit processor receives analog signals from the accelerometer devices as well as from the thermometer and converts them into digital signals which are then outputted and stored on the MWD's tool 109 memory resource 117. Pre-programmed micro-control unit processor 118 is coupled to a central storage unit or memory resource 302 for storing the acquired, retrieved, and computed values, a non-transitory computer readable memory device 303 for performing the operations of initializing, computing, positioning, repeating, and transmitting, both via a master board unit 304. The master board of the pre-programmed micro-control unit processor 118 is used to communicate with internal and external buses such as MWD's tool memory resource 117 or the MWD's tool directional modules. The pre-programming of the non-transitory computer readable memory device 303 is done via a pre-installed firmware and software, which instead controls the memory resource 302 and the master board unit 304. Said non-transitory computer readable memory device 303 may command or receive commands in the form message hook operations to perform certain algorithmic expression. The output is converted into a digital signal, which is then transmitted to the memory resource 115 or the above-surface memory resource 111 and then be used by those skilled in the art for further processing, such as determining the borehole's trajectory.

Figure 4:
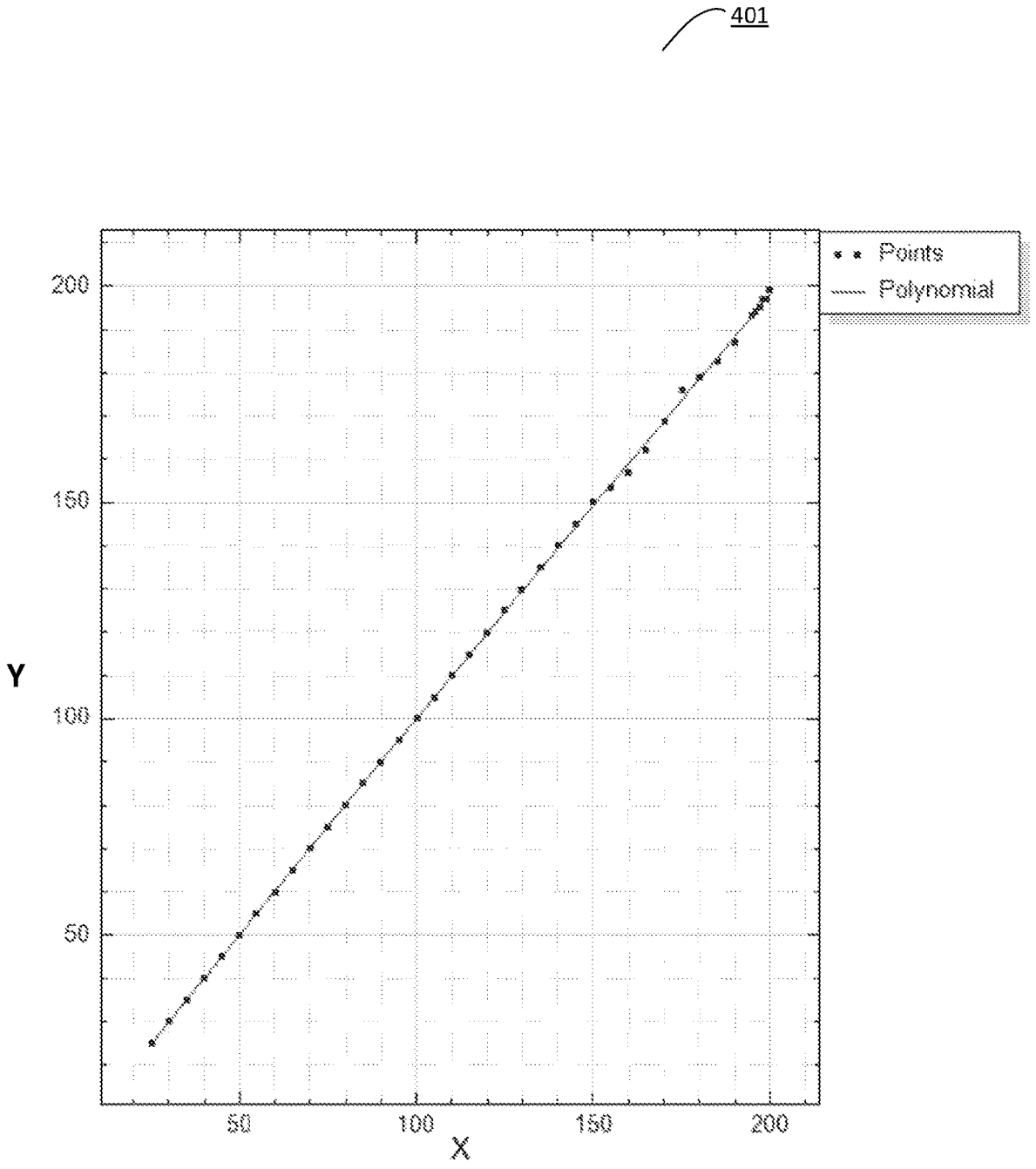
FIG. 4 illustrates in graphic form the temperature error corrections, using the present method of obtaining accuracy gravity coefficients bias error coefficients, according to an embodiment of the present disclosure.

Particularly, FIG. 4 shows at 401 the temperature correction performed by the pre-programmed micro-control unit processor 118 during the first steps of the method presently disclosed. 401 shows the actual acquired temperature data points from the thermometer in the x-axis and in degrees Celsius, while the y-axis illustrates the standard temperature (or known temperature) data points. On the other hand, the computed temperature correction performed after the acquired temperature is calibrated is shown by the straight polynomial line. Functionally, the acquired temperature and the corrected temperature are not the same, which indicates a small deviation. For instance, tests have shown that the actual acquired temperature by the thermometer to be 10° C. ($t_{m1}$) but after completing the calibration process the actual temperature acquired by the thermometer ($t_1$) was 10.1° C.

Figure 5:
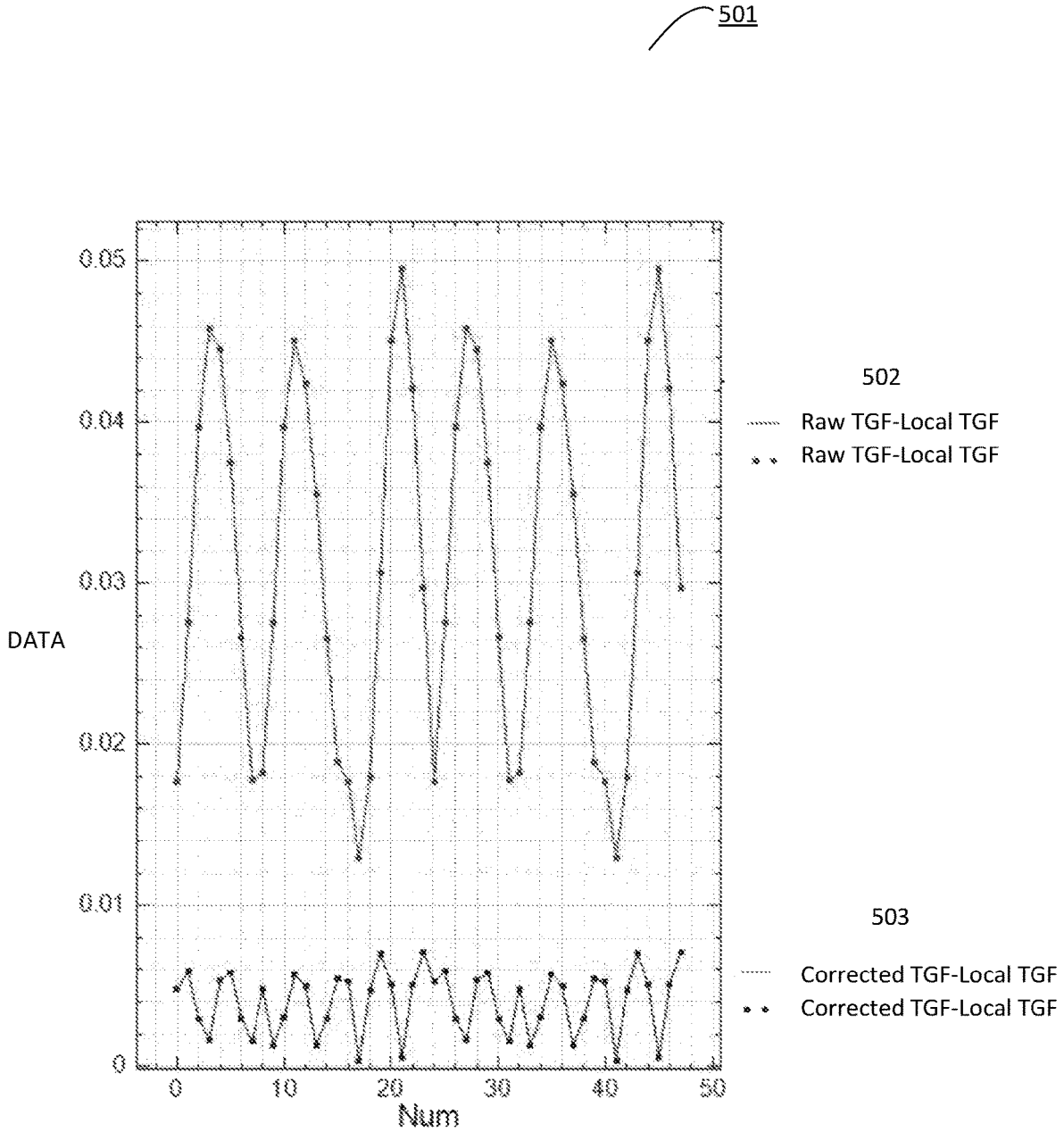
FIG. 5 illustrates in graphic form, a comparison of total gravity data as currently computed by existing methods and the total gravity data when computed using the method of obtaining accuracy gravity coefficients for the three orthogonally oriented accelerometer devices using temperature errors, bias error coefficients, sensitivity error coefficients, and orthogonality error coefficients during measurement while drilling operations, according to an embodiment of the present disclosure.
Figure 6A:
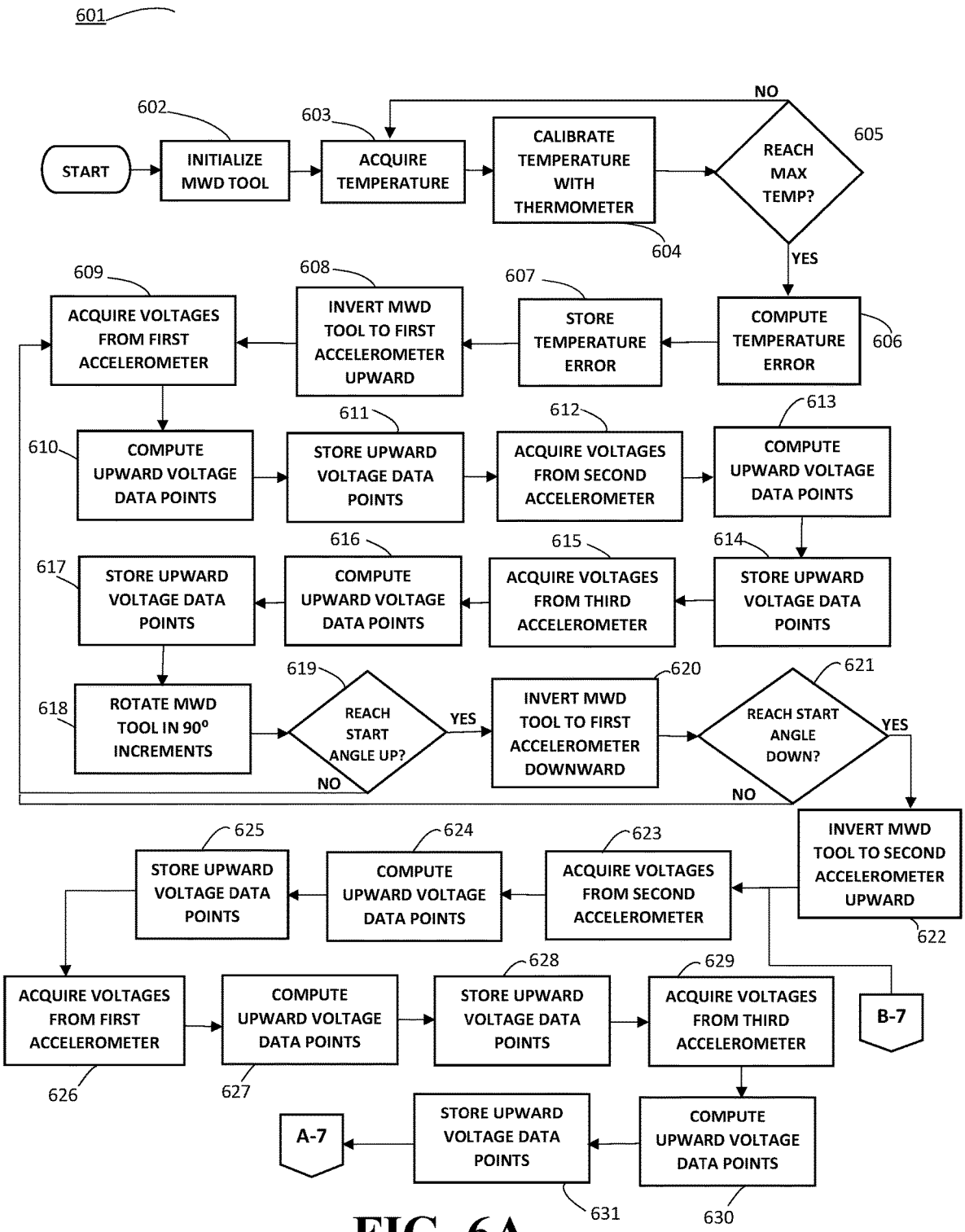
FIG. 6A, FIG. 6B, FIG. 6C, FIG. 6D, and FIG. 6E collectively illustrate a flow chart showing the method of obtaining accuracy gravity coefficients for three orthogonally oriented accelerometer devices using, temperature errors, bias error coefficients, sensitivity error coefficients, and orthogonality error coefficients during measurement while drilling operations, according to an embodiment of the present disclosure.
Figure 6B:
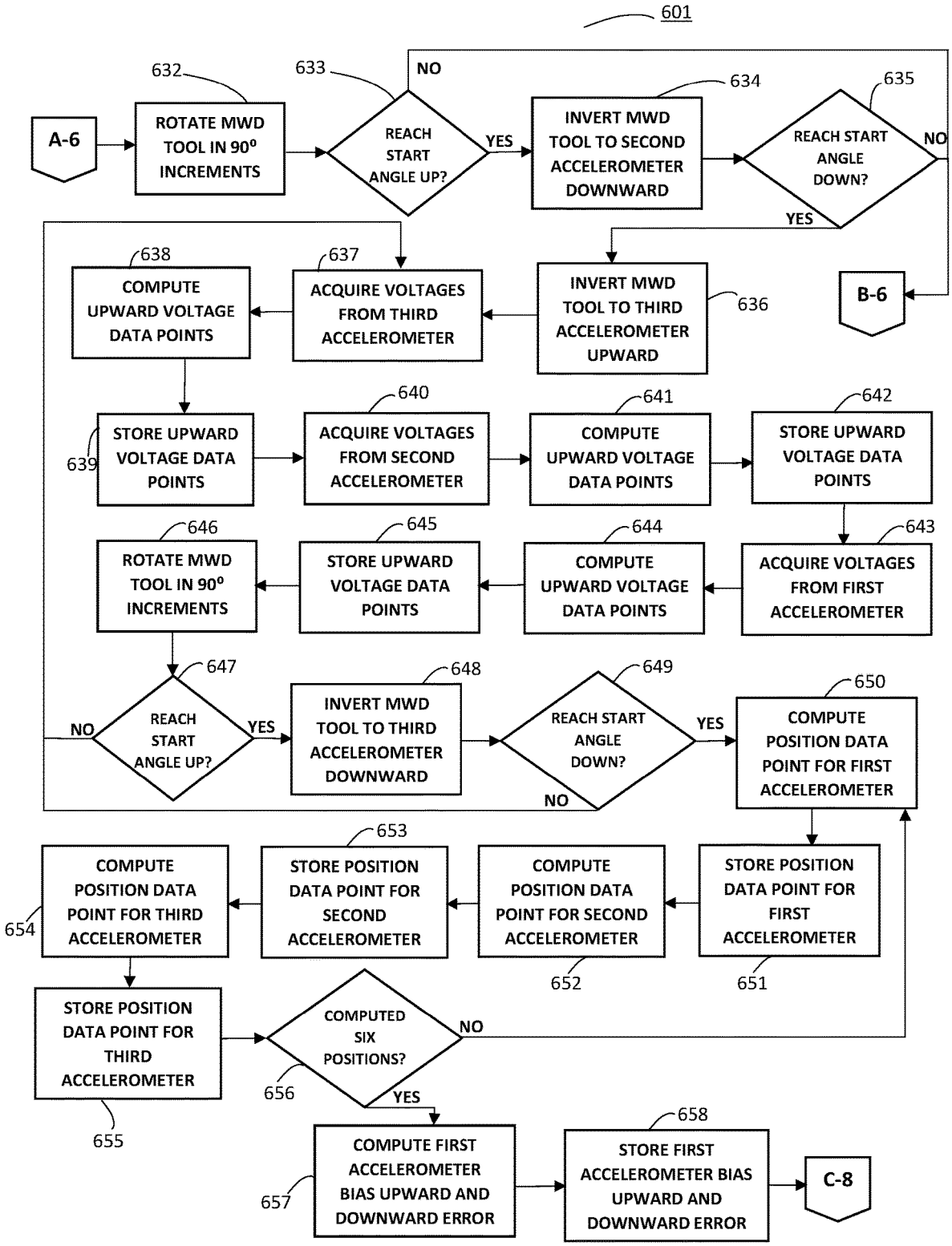
Figure 6C:
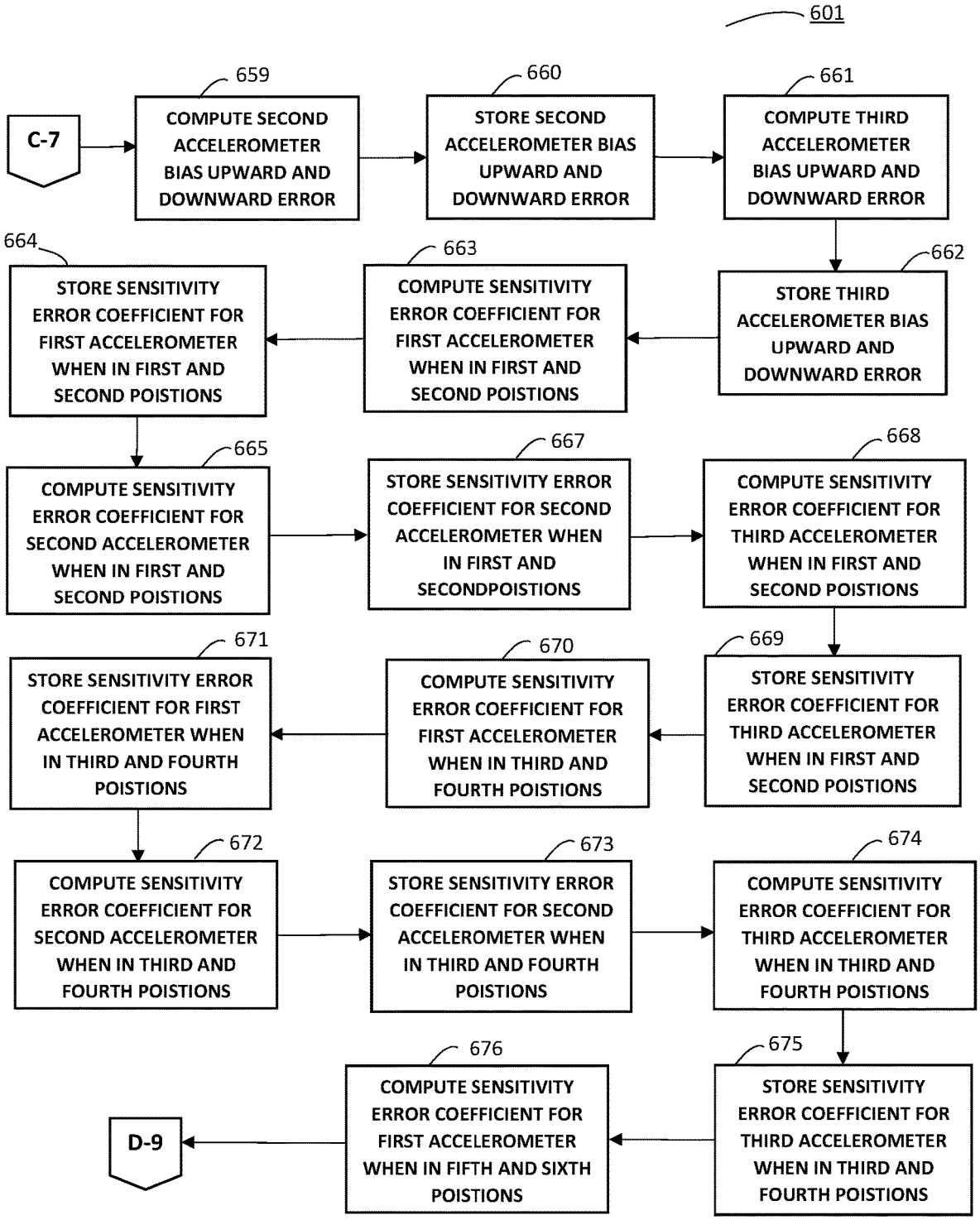
Figure 6D:
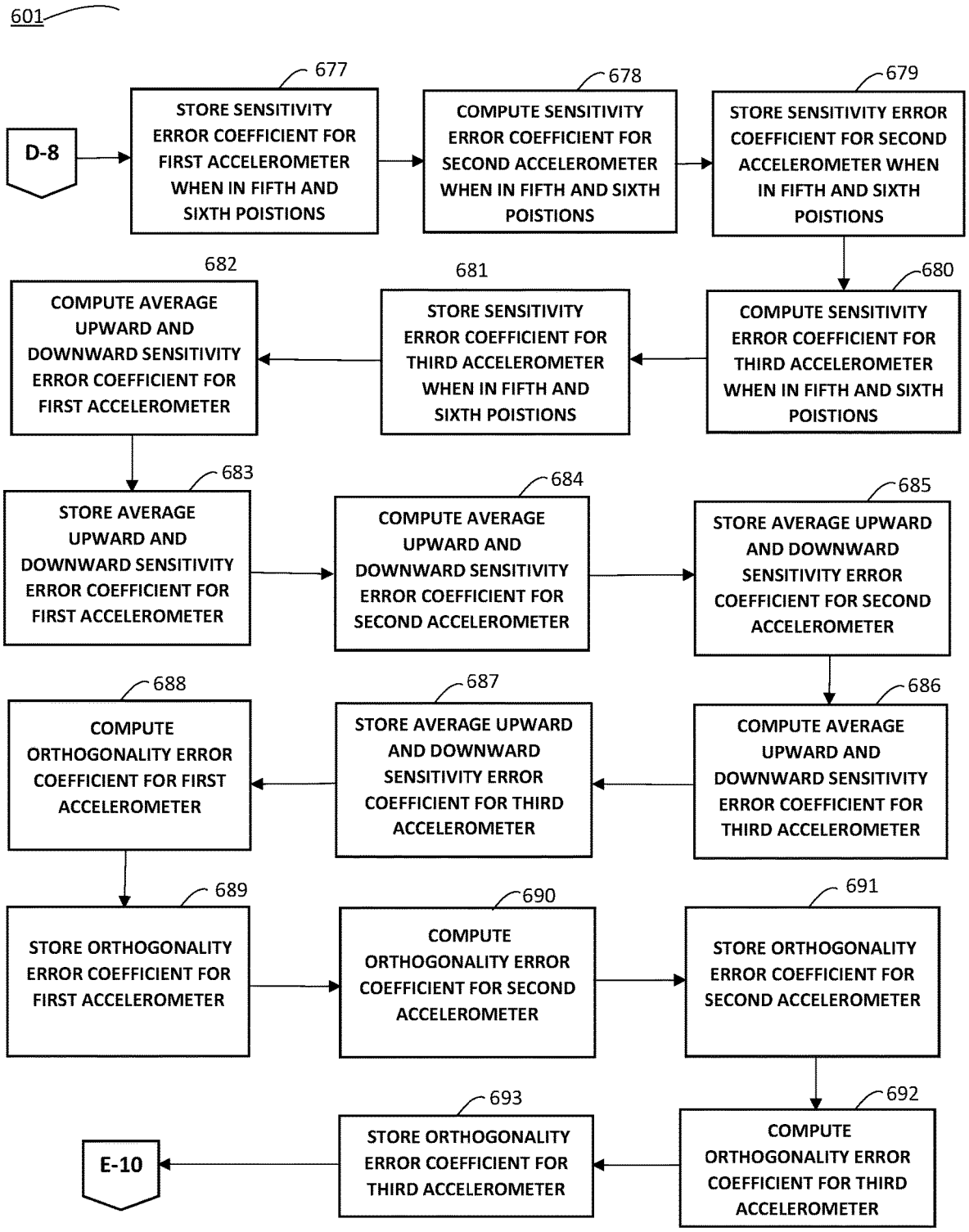
Figure 6E:
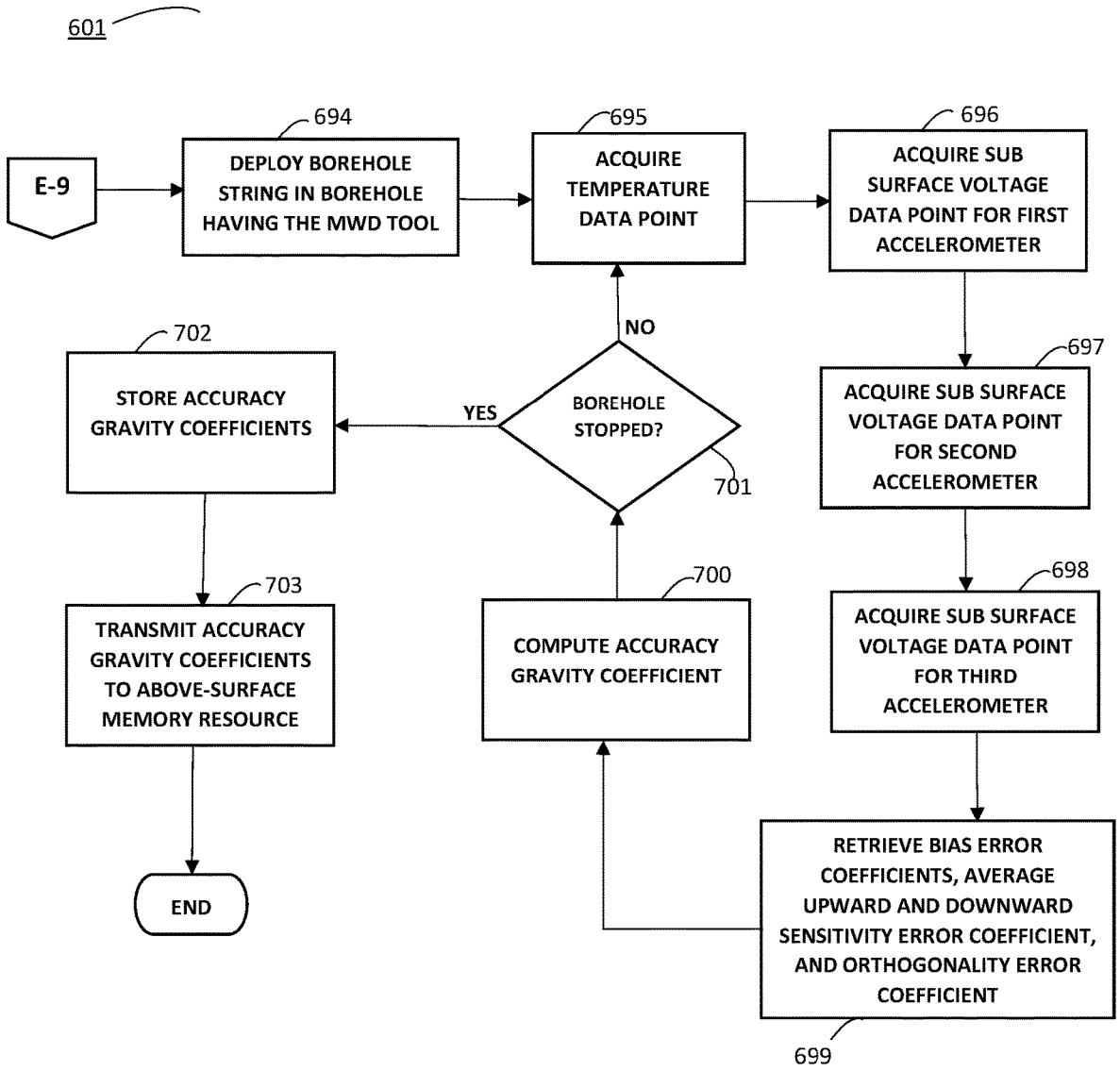

Regarding FIG. 5, one can clearly observed how embodiments of the present disclosure provide a better Total Gravity Field values. Particularly, 501 illustrates in graphic form, a comparison of total gravity data as currently computed by existing methods (502) and the total gravity data when computed using the method of obtaining accuracy gravity coefficients for the three orthogonally oriented accelerometer devices using temperature errors, bias error coefficients, sensitivity error coefficients, and orthogonality error coefficients during measurement while drilling operations (503). Said graphical representation was performed under the same local Total Gravity Field (TGF) of Houston, Tex.—0.99860 G. The absolute difference between the calculated TGF using existing method containing accuracy gravity error coefficients, as observed by 502, are more disperse with values ranging from 0.0125 to 0.0498. On the other hand, 503 shows that when using the accuracy gravity coefficients obtained by the proposed method, the difference between the calculated TGF versus that in the Houston, Tex. area having a TGF of 0.99860 have a narrower range, particularly from 0.003 to 0.078. Persons having ordinary skill in the art will realize that, as accelerometer rely on the mass force acting on the piezoresistive (PR) material, they are easily affected by the vibration or sensor movement. Therefore, when the MWD tool moves or vibrates during a particular measurement, the force acting to the PR material is changing and causing constant resistant changes, which leads to false gravity acceleration measurement creating a wide range of measurements as observed in 502. On the other hand, the ideal measurement situation is when the tool is in a steady condition, with no movement nor vibration, as observed in 503 using the embodiments of the present disclosure.

Lastly, method 601, illustrated as a flowchart in FIG. 6A, FIG. 6B, FIG. 6C, FIG. 6D, and FIG. 6E, describes the process of obtaining accuracy gravity coefficients for the three orthogonally oriented accelerometer devices using, temperature errors, bias error coefficients, sensitivity error coefficients, and orthogonality error coefficients during measurement while drilling operations. As such, the method begins, at 602, by initializing the MWD tool 109, which involves sending the required voltage so that the embedded electronics (i.e., telemetry device 112, thermometer device 113, accelerometer devices 114, 115, 116, memory resource 117, and pre-programmed micro control unit processor 118) are powered. The initializing step 602 can happen above surface or below surface, but it is preferred to occur above surface to properly control the positioning (upwards or downwards) as well the 90-degree rotational increments. Nonetheless, as soon as the MWD tool 109 is initialize, the thermometer device 113 acquires a temperature data point at step 603. Typically, the temperature data point $t_m$ is suffixed with the corresponding sequence number. For instance, the first acquired temperature data point is encoded into the pre-programmed micro control unit processor as $t_{m_1}$, the second one is encoded as $t_{m_2}$ until the maximum allowable temperature of the thermometer device is reached ($t_{m_n}$). Once acquired, these temperature data points are calibrated at step 604 using a pre-programmed expression in the micro control unit processor 118 because, as observed in FIG. 4, there exists variations between the actual temperature data point and that acquired one. The pre-programmed expression is a k-degree polynomial function $T_c(t_m)$ with constants ($c_k$) used to find a best-fit curve where m represents the sequence temperature data point (e.g., $t_1$, $t_2$, $t_3$, etc):

$$T_c(t_m)=c_0+c_1t_m+c_2t_m^2+\ldots+c_kt_m^k \quad (2).$$

Once the first temperature data point ($t_1$) has been calibrated $T_c(t_1)$ the micro control unit processor 118 repeats an n number of times the steps, at 605, the steps of acquiring a temperature data point (603), and calibrating said data point (604) until the maximum allowable temperature of the thermometer device is reached. Typically, the thermometer devices used in the art have a maximum allowable temperature of 250 degrees Celsius. Once said maximum allowable temperature is reached, the micro control unit processor 118 computes at 606 a temperature error coefficient value for each of the calibrated temperature data points in accordance with an algorithm that comprises the following expressions, which are shown from $t_1$ to $t_n$:

$$t_1=T_c(t_{m_1}),t_2=T_c(t_{m_2}),t_3=T_c(t_{m_3}),\ldots t_n=T_c(t_{mn}) \quad (3).$$

Thereafter the micro control unit processor 118 sends at 607 the computed temperature error coefficients to the memory resource 117 for storing at step 607. Although embodiments of the present disclosure also disclose a memory resource (302) embedded within the micro control unit processor 118, said memory resource tends to store minimal amount of data and is also subject to getting damage due to voltage fluctuations, etc. Therefore, it is more convenient to have the pre-programmed micro control unit processor 118 store said temperature error coefficient in a more reliable medium like 117. Correction of the temperature data points acquired by the thermometer device 113 is desirable given that the electronic behavior of the accelerometers 114, 115, and 116 changes when temperature changes. These temperature calibrations or corrections are applied to get the correct readings before the drill string is deployed in the borehole 107 in order to avoid false temperature reading leading to false corrections being applied to the accelerometer devices.

With the temperature error coefficients stored at 608, the MWD tool 109 is positioned, by inverting it to an upward position, wherein a first (x') 114 of the three orthogonally oriented accelerometer devices is also oriented or pointed upward. Referencing Table 1, this is position number 1. The first (x') 114 accelerometer device, which is already facing upwards, begins acquiring at 609 multiple (n) upward voltage data points (i) until the last acquired multiple (n) upward voltage data point ($i_n$) has repeated at least three times. The micro control unit processor 118 verifies that the last voltage data points ($i_n$) have repeated at least three times and being computing at 610 an average voltage data point M(x',j) using the acquired multiple (n) upward voltage data points (i) from the first (x') of the three orthogonally oriented accelerometer devices oriented upward (j) in accordance with the following pre-programmed expression, where j equals 1 for the first position and i represents all the voltage data points acquired by the first accelerometer 114:

$$M(x', j) = \frac{\sum_{i=1}^{n} V(x', i)}{n}. \quad (4)$$

The micro control unit processor 118 then messages the memory resource 117 that it will begin storing, at 611, the computed upward average voltage data point—in this case is (M(x', 1)). Still while the MWD tool 109 is in the upward position with the first 114 accelerometer also facing upwards, the second accelerometer 115 begins acquiring at 612 multiple (n) upward voltage data points (i) until the last acquired multiple (n) upward voltage data point ($i_n$) has repeated at least three times. The micro control unit processor 118 then verifies that said upward voltage data points have repeated three times and, being computing at 613, an upward average voltage data point (M(y',j)) using the acquired multiple (n) upward voltage data points (i) from the second (y') of the three orthogonally oriented accelerometer devices having the first (x') of the three orthogonally oriented accelerometer devices oriented upward (j) in accordance with the following pre-programmed expression, referencing Table 2, means that j is at position number 1:

$$M(y', j) = \frac{\sum_{i=1}^{n} V(y', i)}{n}. \quad (5)$$

The micro control unit processor 118 then messages the memory resource 117 that it will begin storing, at 614, the computed upward average voltage data point which in this case is (M(y',1)). Still while the MWD tool 109 is in the upward position with the first 114 accelerometer also facing upwards, the third (z') of the three orthogonally oriented accelerometer devices begins acquiring at 615 multiple (n) upward voltage data points (i) until the last acquired multiple (n) upward voltage data point ($i_n$) has repeated at least three times. Once again, the micro control unit processor 118 then verifies that said upward voltage data points have repeated three times and, being computing at 616, an upward average voltage data point (M(z',j)) using the acquired multiple (n) upward voltage data points (i) from the third (z') of the three orthogonally oriented accelerometer devices having the first (x') of the three orthogonally oriented accelerometer devices oriented upward (j), in accordance with the following pre-programmed expression, referencing Table 3, means that j is at position number 1:

$$M(z', j) = \frac{\sum_{i=1}^{n} V(z', i)}{n}. \quad (6)$$

The micro control unit processor 118 then messages the memory resource 117 that it will begin storing, at 617, the computed upward average voltage data point, which in this case would now be (M(z',1)). Now the MWD tool 109 rotates to a first 90-degree position around the string or plumb line at 618, and steps 609 through 618 are repeated at 619 until the MWD tool has rotated a full 360 degree in 90-degree increments whereby at each rotation the value of j in the preprogrammed expressions (4), (5), and (6) is incrementally changed pursuant to the corresponding position shown on Table 1, Table 2, and Table 3, respectively, from the first accelerometer 114 is facing upward (e.g., j=2 at first 90 degree increment, j=3 at second 90 degree increment, and j=3 at third 90 degree increment). Upon reaching the starting angle (i.e., angle 0), the MWD tool 109 is positioned at 620 by inverting the measuring while drilling tool to a downward positioned by causing the first (x') of the three orthogonally oriented accelerometer devices to be oriented downward. Again, the MWD tool 109 then rotates in 90-degree increments, starting from position 0-degree around the string or plumb line at 621, until the MWD tool has rotated a full 360 degree in 90-degrees increment whereby at each rotation steps 609 through 618 are repeated, and value of j in the preprogrammed expressions (4), (5), and (6) is incrementally changed, pursuant to the corresponding position shown on Table 1, Table 2, and Table 3, respectively, from the first accelerometer 114 is facing downward (i.e., j=5 at starting increment angle of 0 degrees, j=2 at first 90 degree increment, j=3 at second 90 degree increment, and j=3 at third 90 degree increment).

With the voltage data points for the three accelerometer devices when the first (x') 114 of the three orthogonally oriented accelerometer devices is oriented upward and downward already stored, the MWD tool 109 is now positioned, at 622, by inverting it to an upward position, wherein a second (y') 115 of the three orthogonally oriented accelerometer devices is also oriented or pointed upward, which is position number 9 according to Table 2. At this point, the second (y') 114 accelerometer device, which is already facing upwards, begins acquiring at 623 multiple (n) upward voltage data points (i) until the last acquired multiple (n) upward voltage data point ($i_n$) has repeated at least three times. The micro control unit processor 118 verifies that the last voltage data points ($i_n$) have repeated at least three times and being computing at 624 an average voltage data point M(y',j) using the acquired multiple (n) upward voltage data points (i) from the second (y') of the three orthogonally oriented accelerometer devices oriented upward (j) in accordance with the following pre-programmed expression, where j equals 9 for the first position and i represents all the voltage data points acquired by the second accelerometer 115:

$$M(y', j) = \frac{\sum_{i=1}^{n} V(y', i)}{n}. \tag{7}$$

The micro control unit processor 118 messages the memory resource 117 that it will begin storing, at 625, the computed upward average voltage data point which in this case is (M(y',9)). Still while the MWD tool 109 is in the upward position with the second 115 accelerometer also facing upwards, the first (x') accelerometer 114 begins acquiring at 626 multiple (n) upward voltage data points (i) until the last acquired multiple (n) upward voltage data point ($i_n$) has repeated at least three times. The micro control unit processor 118 verifies that said upward voltage data points have repeated three times and, being computing at 627, an upward average voltage data point (M(x',j)) using the acquired multiple (n) upward voltage data points (i) from the first (x') of the three orthogonally oriented accelerometer devices having the second (y') of the three orthogonally oriented accelerometer devices oriented upward (j) in accordance with the following pre-programmed expression, referencing Table 1, means that j is at position number 9:

$$M(x', j) = \frac{\sum_{i=1}^{n} V(x', i)}{n}. \tag{8}$$

The micro control unit processor 118 messages the memory resource 117 that it will begin storing, at 628, the computed upward average voltage data point, which in this case is (M(x', 9)). Still having the MWD tool 109 is in the upward position with the second 115 accelerometer also facing upwards, the third (z') of the three orthogonally oriented accelerometer devices begins acquiring at 629 multiple (n) upward voltage data points (i) until the last acquired multiple (n) upward voltage data point ($i_n$) has repeated at least three times. Once again, the micro control unit processor 118 then verifies that said upward voltage data points have repeated three times and, being computing at 630, an upward average voltage data point (M(z',j)) using the acquired multiple (n) upward voltage data points (i) from the third (z') of the three orthogonally oriented accelerometer devices having the second (y') of the three orthogonally oriented accelerometer devices oriented upward (j) in accordance with the following pre-programmed expression, referencing Table 3, means that j is at position number 9:

$$M(z', j) = \frac{\sum_{i=1}^{n} V(z', i)}{n}. \tag{9}$$

The micro control unit processor 118 messages the memory resource 117 that it will begin storing, at 631, the computed upward average voltage data point which in this case is (M(z',9)). Now the MWD tool 109 rotates to a first 90-degree position around the string or plumb line at 632 and steps 623 through 632 are repeated at 633 until the MWD tool has rotated a full 360 degree in 90-degree increments whereby at each rotation the value of j in the preprogrammed expressions (4), (5), and (6) is incrementally changed pursuant to the corresponding position shown on Table 1, Table 2, and Table 3, respectively, from the second accelerometer 115 is facing upward (e.g., j=10 at first 90 degree increment, j=11 at second 90 degree increment, and j=12 at third 90 degree increment). Upon reaching the starting angle (i.e., angle 0), the MWD tool 109 is positioned at 634 by inverting the measuring while drilling tool to a downward positioned by causing the second (y') of the three orthogonally oriented accelerometer devices to be oriented downward. Again, the MWD tool 109 then rotates in 90-degree increments, starting from position 0-degree around the string or plumb line at 635, until the MWD tool has rotated a full 360 degree in 90-degrees increment whereby at each rotation steps 623 through 632 are repeated, and the value of j in the preprogrammed expressions (4), (5), and (6) is incrementally changed, pursuant to the corresponding position shown on Table 1, Table 2, and Table 3, respectively, from when the second accelerometer 115 is facing downward (i.e., j=13 at starting increment angle of 0 degrees, j=14 at first 90 degree increment, j=15 at second 90 degree increment, and j=16 at third 90 degree increment).

With the voltage data points for the three accelerometer devices when the second (y') 114 of the three orthogonally oriented accelerometer devices is oriented upward and downward already stored, the MWD tool 109 is now positioned, at 636, by inverting it to an upward position, wherein a third (z') 115 of the three orthogonally oriented accelerometer devices is also oriented or pointed upward. Referencing Table 3, this is position number 17. At this point, the third (z') 114 accelerometer device, which is already facing upwards, begins acquiring at 637 multiple (n) upward voltage data points (i) until the last acquired multiple (n) upward voltage data point ($i_n$) has repeated at least three times. The micro control unit processor 118 verifies that the last voltage data points (in) have repeated at least three times and being computing at 638 an average voltage data point M(z',j) using the acquired multiple (n) upward voltage data points (i) from the third (z') of the three orthogonally oriented accelerometer devices oriented upward (j) in accordance with the following pre-programmed expression, where j equals 17 for the first position and i represents all the voltage data points acquired by the third accelerometer 116:

$$M(z', j) = \frac{\sum_{i=1}^{n} V(z', i)}{n}. \tag{9}$$

The micro control unit processor 118 messages the memory resource 117 that it will begin storing, at 639, the computed upward average voltage data point which in this case is (M(z',17)). Still while the MWD tool 109 is in the upward position with the second 115 accelerometer also facing upwards, the second (y') accelerometer 115, begins acquiring at 640 multiple (n) upward voltage data points (i) until the last acquired multiple (n) upward voltage data point ($i_n$) has repeated at least three times. The micro control unit processor 118 verifies that said upward voltage data points have repeated three times and, being computing at 641, an upward average voltage data point (M(y',j)) using the acquired multiple (n) upward voltage data points (i) from the second (y') of the three orthogonally oriented accelerometer devices having the third (z') of the three orthogonally oriented accelerometer devices oriented upward (j) in accordance with the following pre-programmed expression, referencing Table 2, means that j is at position number 17:

$$M(y', j) = \frac{\sum_{i=1}^{n} V(y', i)}{n}. \tag{10}$$

The micro control unit processor 118 then messages the memory resource 117 that it will begin storing, at 642, the computed upward average voltage data point which in this case is (M(y',17)). Still having the MWD tool 109 is in the upward position with the third 116 accelerometer also facing upwards, the first (x') of the three orthogonally oriented accelerometer devices begins acquiring at 643 multiple (n) upward voltage data points (i) until the last acquired multiple (n) upward voltage data point ($i_n$) has repeated at least three times. Once again, the micro control unit processor 118 then verifies that said upward voltage data points have repeated three times and, being computing at 644, an upward average voltage data point (M(x',j)) using the acquired multiple (n) upward voltage data points (i) from the first (x') of the three orthogonally oriented accelerometer devices having the third (z') of the three orthogonally oriented accelerometer devices oriented upward (j) in accordance with the following pre-programmed expression, referencing Table 1, means that j is at position number 17:

$$M(x', j) = \frac{\sum_{i=1}^{n} V(x', i)}{n}. \tag{11}$$

The micro control unit processor 118 messages the memory resource 117 that it will begin storing, at 645, the computed upward average voltage data point which in this case is (M(x',17)). Now the MWD tool 109 rotates to a first 90-degree position around the string or plumb line at 646 and steps 637 through 646 are repeated at 647, until the MWD tool has rotated a full 360 degree in 90-degree increments whereby at each rotation the value of j in the preprogrammed expressions (4), (5), and (6) is incrementally changed pursuant to the corresponding position shown on Table 1, Table 2, and Table 3, respectively, from when the third accelerometer 116 is facing upward (e.g., j=18 at first 90 degree increment, j=18 at second 90 degree increment, and j=20 at third 90 degree increment). Upon reaching the starting angle (i.e., angle 0), the MWD tool 109 is positioned at 648 by inverting the measuring while drilling tool to a downward positioned by causing the third (z') of the three orthogonally oriented accelerometer devices to be oriented downward. Again, the MWD tool 109 then rotates in 90-degree increments, starting from position 0-degree around the string or plumb line at 649 until the MWD tool has rotated a full 360 degree in 90-degrees increment whereby at each rotation steps 637 through 646 are repeated, and that value of j in the preprogrammed expressions (4), (5), and (6) is incrementally changed, pursuant to the corresponding position shown on Table 1, Table 2, and Table 3, respectively, from when the third accelerometer 116 is facing downward (i.e., j=21 at starting increment angle of 0 degrees, j=22 at first 90 degree increment, j=23 at second 90 degree increment, and j=24 at third 90 degree increment).

Upon successfully completing the last storage of the computed downward average voltage data point (M(x', 24)), the pre-programmed micro-control unit processor 118 begins computing at 650 a first position data point for the first (x') of the three orthogonally oriented accelerometer devices when the first (x') of the three orthogonally oriented accelerometer devices is oriented upward and at the different positions as it rotates (i.e., when j=1, j=2, j=3, and j=4) in accordance with the following pre-programmed expression:

$$P(x', 1) = \frac{\sum_{j=1}^{4} M(x', j)}{4}. \tag{12}$$

The computed first position data point from the first (x') of the three orthogonally oriented accelerometer devices when said first (x') of the three orthogonally oriented accelerometer devices is oriented upward is then stored at 651.

The pre-programmed micro-control unit processor 118 begins computing at 652 a first position data point for the second (y') of the three orthogonally oriented accelerometer devices when the first (x') of the three orthogonally oriented accelerometer devices is oriented upward and at the different positions as it rotates (i.e., when j=1,j=2,j=3, and j=4) in accordance with the following pre-programmed expression:

$$P(y', 1) = \frac{\sum_{j=1}^{4} M(y', j)}{4}. \tag{13}$$

The computed first position data point from the second (y') of the three orthogonally oriented accelerometer devices when the first (x') of the three orthogonally oriented accelerometer devices is oriented upward is then stored at 653.

The pre-programmed micro-control unit processor 118 begins computing at 654 a first position data point for the third (z') of the three orthogonally oriented accelerometer devices when the first (x') of the three orthogonally oriented accelerometer devices is oriented upward and at the different positions as it rotates (i.e., when j=1, j=2, j=3, and j=4) in accordance with the following pre-programmed expression:

$$P(z', 1) = \frac{\sum_{j=1}^{4} M(z', j)}{4}. \tag{14}$$

The computed first position data point from the third (z') of the three orthogonally oriented accelerometer devices when the first (x') of the three orthogonally oriented accelerometer devices is oriented upward is then stored at 655.

The steps 650 through 655 are repeated for all different positions at 656 (i.e., first (x') up, first (x') down, second (y') up, second (y') down, third (z') up, and third (z') down) and at each rotating increment angle (i.e., 0-degrees, 90-degrees, 180-degrees, 270-degrees) in accordance with the following pre-programmed expressions:

a second position data point for the first (x') of the three orthogonally oriented accelerometer devices when the first (x') of the three orthogonally oriented accelerometer devices is oriented downward:

$$P(x', 2) = \frac{\sum_{j=5}^{8} M(x', j)}{4}; \tag{15}$$

a second position data point for the second (y') of the three orthogonally oriented accelerometer devices when the first (x') of the three orthogonally oriented accelerometer devices is oriented downward:

$$P(y', 2) = \frac{\sum_{j=5}^{8} M(y', j)}{4}; \tag{16}$$

a second position data point for the third (z') of the three orthogonally oriented accelerometer devices and the first (x') of the three orthogonally oriented accelerometer devices is oriented downward:

$$P(z', 2) = \frac{\sum_{j=5}^{8} M(z', j)}{4}; \tag{17}$$

a third position data point for the first (x') of the three orthogonally oriented accelerometer devices when the second (y') of the three orthogonally oriented accelerometer devices is oriented upward:

$$P(x', 3) = \frac{\sum_{j=9}^{12} M(x', j)}{4}; \tag{18}$$

a third position data point for the second (y') of the three orthogonally oriented accelerometer devices when the second (y') of the three orthogonally oriented accelerometer devices is oriented upward:

$$P(y', 3) = \frac{\sum_{j=9}^{12} M(y', j)}{4}; \tag{19}$$

a third position data point for the third (z') of the three orthogonally oriented accelerometer devices when the second (y') of the three orthogonally oriented accelerometer devices is oriented upward:

$$P(z', 3) = \frac{\sum_{j=5}^{8} M(z', j)}{4}; \tag{20}$$

a fourth position data point for the first (x') of the three orthogonally oriented accelerometer devices when the second (y') of the three orthogonally oriented accelerometer devices is oriented downward:

$$P(x', 4) = \frac{\sum_{j=13}^{16} M(x', j)}{4}; \tag{21}$$

a fourth position data point for the second (y') of the three orthogonally oriented accelerometer devices when the second (y') of the three orthogonally oriented accelerometer devices is oriented downward:

$$P(y', 4) = \frac{\sum_{j=13}^{16} M(y', j)}{4}; \tag{22}$$

a fourth position data point for the third (z') of the three orthogonally oriented accelerometer devices when the second (y') of the three orthogonally oriented accelerometer devices is oriented downward:

$$P(z', 4) = \frac{\sum_{j=13}^{16} M(z', j)}{4}; \tag{23}$$

a fifth position data point for the first (x') of the three orthogonally oriented accelerometer devices when the third (z') of the three orthogonally oriented accelerometer devices is oriented upward:

$$P(x', 5) = \frac{\sum_{j=17}^{20} M(x', j)}{4}; \tag{24}$$

a fifth position data point for the second (y') of the three orthogonally oriented accelerometer devices when the third (z') of the three orthogonally oriented accelerometer devices is oriented upward:

$$P(y', 5) = \frac{\sum_{j=17}^{20} M(y', j)}{4}; \tag{25}$$

a fifth position data point for the third (z') of the three orthogonally oriented accelerometer devices when the third (z') of the three orthogonally oriented accelerometer devices is oriented upward:

$$P(z', 5) = \frac{\sum_{j=17}^{20} M(z', j)}{4}; \tag{26}$$

a sixth position data point for the first (x') of the three orthogonally oriented accelerometer devices when the third (z') of the three orthogonally oriented accelerometer devices is oriented downward:

$$P(x', 6) = \frac{\sum_{j=21}^{24} M(x', j)}{4}; \tag{27}$$

a sixth position data point for the second (y') of the three orthogonally oriented accelerometer devices when the third (z') of the three orthogonally oriented accelerometer devices is oriented downward:

$$P(y', 6) = \frac{\sum_{j=21}^{24} M(y', j)}{4}; \tag{28}$$

and a sixth position data point for the third (z') of the three orthogonally oriented accelerometer devices when the third (z') of the three orthogonally oriented accelerometer devices is oriented downward:

$$P(z', 6) = \frac{\sum_{j=21}^{24} M(z', j)}{4}. \tag{29}$$

When the position data points are computed by the pre-programmed micro-control unit processor 118 and stored to the memory resource 117, the pre-programmed micro-control unit processor 118 begins computing at 657 a bias upward and downward error coefficient ($V_{x'b}$) for the first (x') of the three orthogonally oriented accelerometer devices, using the stored first, second, third, fourth, fifth, and sixth position data point data points P(x',1), P(x', 2), P(x', 3), P(x', 4), P(x', 5), and P(x', 6) in accordance with the following pre-programmed expression:

$$V_{x'b} = \frac{\sum_{i=1}^{6} P(x', i)}{6}. \tag{30}$$

The bias upward and downward error coefficient ($V_{x'b}$) for the first (x') of the three orthogonally oriented accelerometer devices is then stored by the pre-programmed micro-control unit processor 118 to the memory resource 117 at step 658, which signals by a message hook to the pre-programmed micro-control unit processor 118 that it can start computing at 659 a bias upward and downward error coefficient ($V_{y'b}$) for the second (y') of the three orthogonally oriented accelerometer devices, using the stored first, second, third, fourth, fifth, and sixth position data point data points P(y',1), P(y',2), P(y',3), P(y', 4), P(y', 5), and P(y', 6), in accordance with the following pre-programmed expression:

$$V_{y'b} = \frac{\sum_{i=1}^{6} P(y', i)}{6}. \tag{31}$$

Similarly, the bias upward and downward error coefficient ($V_{y'b}$) for the second (y') of the three orthogonally oriented accelerometer devices, is then stored by the pre-programmed micro-control unit processor 118 to the memory resource 117 at step 660, which signals, by a message hook to the pre-programmed micro-control unit processor 118 that it can start computing at 661 a bias upward and downward error coefficient ($V_{z'b}$) for the third (z') of the three orthogonally oriented accelerometer devices, using the stored first, second, third, fourth, fifth, and sixth position data point data points P(z',1), P(z', 2), P(z', 3), P(z', 4), P(z', 5), and P(z', 6) in accordance with the following pre-programmed expression:

$$V_{z'b} = \frac{\sum_{i=1}^{6} P(z', i)}{6}. \tag{32}$$

Thereafter, at step 662, the computed bias upward and downward error coefficient ($V_{z'b}$) from the third (z') of the of the three orthogonally oriented accelerometer devices is stored to the memory resource 117 by the pre-programmed micro-control unit processor 118, which then begins computing at 663 an upward and downward sensitivity error coefficient ($S_{x'x}$) for the first (x') of the three orthogonally oriented accelerometer devices, using the stored first position data point when the first (x') of the three orthogonally oriented accelerometer devices is oriented upward (P(x',1)), using the second position data point when the first (x') of the three orthogonally oriented accelerometer devices is oriented downward (P(x', 2)), and a local gravity force data point (g) acquired by the first (x') of the three orthogonally oriented accelerometer devices in accordance with the following pre-programmed expression:

$$S_{x'x} = \frac{P(x', 1) - P(x', 2)}{2g}. \quad (33)$$

The computed upward and downward sensitivity error coefficient ($S_{x'x}$) from the first (x') of the of the three orthogonally oriented accelerometer devices when the first (x') of the three orthogonally oriented accelerometer devices is oriented upward and downward is then stored at 664 to the memory resource by the pre-programmed micro-control unit processor and the process of computing at 665 an upward and downward sensitivity error coefficient ($S_{y'x}$) for the second (y') of the three orthogonally oriented accelerometer devices, using the first position data point when the first (x') of the three orthogonally oriented accelerometer devices is oriented upward (P(y',1)), using the second position data point when the first (x') of the three orthogonally oriented accelerometer devices is oriented downward (P(y', 2)), and a local gravity force data point (g) acquired by the second (y') of the three orthogonally oriented accelerometer devices in accordance with the following pre-programmed expression:

$$S_{y'x} = \frac{P(y', 1) - P(y', 2)}{2g}. \quad (34)$$

The computed upward and downward sensitivity error coefficient ($S_{y'x}$) from the second (y') of the of the three orthogonally oriented accelerometer devices when the first (x') of the three orthogonally oriented accelerometer devices is oriented upward and downward is then stored at 667 (note that the number between 665 and 667 is omitted for simplicity). Thereafter, an upward and downward sensitivity error coefficient ($S_{z'x}$) for the third (z') of the three orthogonally oriented accelerometer devices, using the first position data point when the first (x') of the three orthogonally oriented accelerometer devices is oriented upward (P(z',1)), using the stored second position data point when the first (x') of the three orthogonally oriented accelerometer devices is oriented downward (P(z', 2)), and a local gravity force data point (g) acquired by the third (z') of the three orthogonally oriented accelerometer devices is computed at 668 in accordance with the following pre-programmed expression:

$$S_{z'x} = \frac{P(z', 1) - P(z', 2)}{2g}. \quad (35)$$

Then the pre-programmed micro-control unit processor 118 stores at 669 to the memory resource 117 the computed upward and downward sensitivity error coefficient ($S_{z'x}$) from the third (z') of the of the three orthogonally oriented accelerometer devices when the first (x') of the three orthogonally oriented accelerometer devices is oriented upward and downward. Upon successfully completing the storage procedure, the memory resource 117 signals through a message hook procedure to the pre-programmed micro-control unit processor 118 to begin computing at 670 an upward and downward sensitivity error coefficient ($S_{x'y}$) for the first (x') of the three orthogonally oriented accelerometer devices, using the stored third position data point when the second (y') of the three orthogonally oriented accelerometer devices is oriented upward (P(x',3)), using the stored fourth position data point when the second (y') of the three orthogonally oriented accelerometer devices is oriented downward (P(x', 4)) and a local gravity force data point (g) acquired by the first (x') of the three orthogonally oriented accelerometer devices in accordance with the following pre-programmed expression:

$$S_{x'y} = \frac{P(x', 3) - P(x', 4)}{2g}. \quad (36)$$

Thereafter, the pre-programmed micro-control unit processor 118 stores at 671 to the memory resource 117 the computed upward and downward sensitivity error coefficient ($S_{x'y}$) from the first (x') of the of the three orthogonally oriented accelerometer devices when the second (y') of the three orthogonally oriented accelerometer devices is oriented upward and downward. Once again, upon successfully completing the storage procedure, the memory resource 117 signals through a message hook procedure to the pre-programmed micro-control unit processor 118 to begin computing at 672 an upward and downward sensitivity error coefficient ($S_{y'y}$) for the second (y') of the three orthogonally oriented accelerometer devices using the stored third position data point when the second (y') of the three orthogonally oriented accelerometer devices is oriented upward (P(y', 3)) using the fourth position data point when the second (y') of the three orthogonally oriented accelerometer devices is oriented downward (P(y', 4)), and a local gravity force data point (g) acquired by the second (y') of the three orthogonally oriented accelerometer devices in accordance with the following pre-programmed expression:

$$S_{y'y} = \frac{P(y', 3) - P(y', 4)}{2g}. \quad (37)$$

Upon completion of the computing procedure 672, the pre-programmed micro-control unit processor 118 stores at 673 to the memory resource 117 the computed upward and downward sensitivity error coefficient ($S_{y'y}$) from the second (y') of the of the three orthogonally oriented accelerometer devices when the second (y') of the three orthogonally oriented accelerometer devices is oriented upward and downward. The pre-programmed micro-control unit processor 118 receives a message hook from the memory resource 117 that it has completed storage 673 and begins computing at 674 an upward and downward sensitivity error coefficient ($S_{z'y}$) for the third (z') of the three orthogonally oriented accelerometer devices, using the stored third position data point (y') of the three orthogonally oriented accelerometer devices is oriented upward (P(z', 3)), using the stored fourth position data point when the second (y') of the three orthogonally oriented accelerometer devices is oriented downward (P(z', 4)), and a local gravity force data point (g) acquired by the third (z') of the three orthogonally oriented accelerometer devices in accordance with the following pre-programmed expression:

$$S_{z'y} = \frac{P(z', 3) - P(z', 4)}{2g}. \quad (38)$$

The pre-programmed micro-control unit processor 118 then begins storing at 675 to memory resource 117 the computed upward and downward sensitivity error coefficient ($S_{z'y}$) from the third (z') of the of the three orthogonally oriented accelerometer devices when the second (y') of the three orthogonally oriented accelerometer devices is oriented upward and downward. Then the pre-programmed micro-control unit processor 118 receives a message hook from the memory resource 117 that it has completed storage 675 and begins computing at 676 an upward and downward sensitivity error coefficient ($S_{x'z}$) for the first (x') of the three orthogonally oriented accelerometer devices using the stored fifth position data point when the third (z') of the three orthogonally oriented accelerometer devices is oriented upward (P(x', 5)) using the stored sixth position data point when the third (z') of the three orthogonally oriented accelerometer devices is oriented downward (P(x', 6)), and a local gravity force data point (g) acquired by the first (x') of the three orthogonally oriented accelerometer devices in accordance with the following pre-programmed expression:

$$S_{x'z} = \frac{P(x', 5) - P(x', 6)}{2g}. \tag{39}$$

Then, the pre-programmed micro-control unit processor 118 stores at 677 to the memory resource 117 the computed upward and downward sensitivity error coefficient ($S_{x'z}$) from the first (x') of the of the three orthogonally oriented accelerometer devices when the third (z') of the three orthogonally oriented accelerometer devices is oriented upward and downward. The successful storage triggers message hook from the memory resource 117 to the pre-programmed micro-control unit processor 118, which in turn begins computing, at 678, an upward and downward sensitivity error coefficient ($S_{y'z}$) for the second (y') of the three orthogonally oriented accelerometer devices, using the stored fifth position data point when the third (z') of the three orthogonally oriented accelerometer devices is oriented upward (P(y', 5)), using the stored sixth position data point when the third (z') of the three orthogonally oriented accelerometer devices is oriented downward (P(y', 6)), and a local gravity force data point (g) acquired by the second (y') of the three orthogonally oriented accelerometer devices in accordance with the following pre-programmed expression:

$$S_{y'z} = \frac{P(y', 5) - P(y', 6)}{2g}. \tag{40}$$

The abovementioned computed upward and downward sensitivity error coefficient ($S_{y'z}$) from the second (y') of the of the three orthogonally oriented accelerometer devices when the third (z') of the three orthogonally oriented accelerometer devices is oriented upward and downward is then stored at 679 to the memory resource 117 by the pre-programmed micro-control unit processor 108. A message hook to the pre-programmed micro-control unit processor 108 indicates the successful storage of the upward and downward sensitivity error coefficient ($S_{y'z}$) has been performed and the pre-programmed micro-control unit processor 108 begins computing at 680 the last of the upward and downward sensitivity error coefficients, particularly, the upward and downward sensitivity error coefficient ($S_{z'z}$) for the third (z') of the three orthogonally oriented accelerometer devices, using the stored fifth position data point when the third (z') of the three orthogonally oriented accelerometer devices is oriented upward (P(z', 5)). The pre-programmed micro-control unit processor 108 performs said computing operation using the stored sixth position data point when the third (z') of the three orthogonally oriented accelerometer devices is oriented downward (P(z', 6)) and a local gravity force data point (g) acquired by the third (z') of the three orthogonally oriented accelerometer devices in accordance with the following pre-programmed expression:

$$S_{z'z} = \frac{P(z', 5) - P(z', 6)}{2g}. \tag{41}$$

Then, it is stored at 681 to the memory resource by the pre-programmed micro-control unit processor the computed upward and downward sensitivity error coefficient ($S_{z'z}$) from the third (z') of the of the three orthogonally oriented accelerometer devices when the third (z') of the three orthogonally oriented accelerometer devices is oriented upward and downward. Having successfully completed all storage procedures for the upward and downward sensitivity error coefficients, the pre-programmed micro-control unit processor 108 switches to computing an average upward and downward sensitivity error coefficients using the aforementioned stored upward and downward sensitivity error coefficients. The first computed average upward and downward sensitivity error coefficient occurs at step 682, wherein said average is computed for the first (x') of the of the three orthogonally oriented accelerometer devices using the stored upward and downward sensitivity error coefficient ($S_{x'x}$) from the first (x') of the of the three orthogonally oriented accelerometer devices when the first (x') of the three orthogonally oriented accelerometer devices is oriented upward and downward, the stored upward and downward sensitivity error coefficient ($S_{x'y}$) from the first (x') of the of the three orthogonally oriented accelerometer devices when the second (y') of the three orthogonally oriented accelerometer devices is oriented upward and downward, and the stored upward and downward sensitivity error coefficient ($S_{x'z}$) from the first (x') of the of the three orthogonally oriented accelerometer devices when the third (z') of the three orthogonally oriented accelerometer devices is oriented upward and downward, in accordance with the following pre-programmed expression:

$$S_{x'} = \sqrt{(S_{x'x})^2 + (S_{x'y})^2 + (S_{x'z})^2} \tag{42}.$$

The pre-programmed micro-control unit processor 118 stores at 683 to the memory resource 117 said computed average upward and downward sensitivity error coefficient for the first (x') of the of the three orthogonally oriented accelerometer devices and messages the pre-programmed micro-control unit processor 118 to begin computing, at 684, an average upward and downward sensitivity error coefficient for the second (y') of the of the three orthogonally oriented accelerometer devices using the stored upward and downward sensitivity error coefficient ($S_{y'x}$) from the first (x') of the of the three orthogonally oriented accelerometer devices when the first (x') of the three orthogonally oriented accelerometer devices is oriented upward and downward, the stored upward and downward sensitivity error coefficient ($S_{y'y}$) from the second (y') of the of the three orthogonally oriented accelerometer devices when the second (y') of the three orthogonally oriented accelerometer devices is oriented upward and downward, and the stored upward and downward sensitivity error coefficient ($S_{y'z}$) from the second (y') of the of the three orthogonally oriented accelerometer devices when the third (z') of the three orthogonally oriented accelerometer devices is oriented upward and downward, in accordance with the following pre-programmed expression:

$$S_{y'}=\sqrt{(S_{y'x})^2+(S_{y'y})^2+(S_{y'z})^2} \quad (43).$$

Once more, the pre-programmed micro-control unit processor 118 begins the process of storing to the memory resource 117, but this time it is the computed average upward and downward sensitivity error coefficient for the second (y') of the of the three orthogonally oriented accelerometer devices referenced as step 685. Thereafter, the pre-programmed micro-control unit processor 118 receives message hook procedure to begin computing the last average upward and downward sensitivity error coefficient. Particularly the pre-programmed micro-control unit processor 118 computes 686 an average upward and downward sensitivity error coefficient for the third (z') of the of the three orthogonally oriented accelerometer devices using the stored upward and downward sensitivity error coefficient ($S_{z'x}$) from the third (z') of the of the three orthogonally oriented accelerometer devices when the first (x') of the three orthogonally oriented accelerometer devices is oriented upward and downward, the stored upward and downward sensitivity error coefficient ($S_{z'y}$) from the third (z') of the of the three orthogonally oriented accelerometer devices when the second (y') of the three orthogonally oriented accelerometer devices is oriented upward and downward, and the stored upward and downward sensitivity error coefficient ($S_{z'z}$) from the third (z') of the of the three orthogonally oriented accelerometer devices when the third (z') of the three orthogonally oriented accelerometer devices is oriented upward and downward in accordance with the following pre-programmed expression:

$$S_{z'}=\sqrt{(S_{z'x})^2+(S_{z'y})^2+(S_{z'z})^2} \quad (44)$$

This last average upward and downward sensitivity error coefficient for the third (z') of the of the three orthogonally oriented accelerometer devices is then stored at 687 to the memory resource by the pre-programmed micro-control unit processor, and the memory resource 117 signals the pre-programmed micro-control unit processor that it can computing the various orthogonality error coefficients.

Further, computing orthogonality error coefficient includes a computational step and a storage step. The first of those computational steps occurs at 688, when the pre-programmed micro-control unit processor computes an orthogonality error coefficient for the first (x') of the of the three orthogonally oriented accelerometer devices in accordance with the following pre-programmed expression:

$$\cos(x', x) = \frac{s_{x'x}}{s_{x'}}. \quad (45)$$

Said computed orthogonality error coefficient for the first (x') of the of the three orthogonally oriented accelerometer devices then is stored at 689 to the memory resource 117 by the pre-programmed micro-control unit processor 118, which then receives a message hook upon successful completion of the storage procedure that it can begin computing at 690 an orthogonality error coefficient for the second (y') of the of the three orthogonally oriented accelerometer devices in accordance with the following pre-programmed expression:

$$\cos(y', y) = \frac{s_{y'y}}{s_{y'}}. \quad (46)$$

Thereafter, the computed orthogonality error coefficient for the second (y') of the of the three orthogonally oriented accelerometer devices is stored at 691 to the memory resource by the pre-programmed micro-control unit processor, who, upon successful completion of the storage procedure, receives a message hook and begins computing at 692 the last of the orthogonality error coefficients. Particularly, this computational step occurs for the orthogonality error coefficient of the third (z') of the of the three orthogonally oriented accelerometer devices in accordance with the following pre-programmed expression:

$$\cos(z', z) = \frac{s_{z'z}}{s_{z'}}. \quad (47)$$

Lastly, the memory resource receives from the pre-programmed micro-control unit processor the computed orthogonality error coefficient for the third (z') of the of the three orthogonally oriented accelerometer devices and begins the process of storage at 693. This last step indicates to the borehole through the drill string that the MWD tool is pre-loaded with temperature errors, the bias error coefficients, the sensitivity error coefficients, and the orthogonality error coefficient and can be deployed sub-surface at 694 to start the drilling process. As the drill string extends underneath the earth's formation, it begins to acquire a temperature data point (t) at step 695, a sub-surface voltage data point ($V_{x'm}$) by the first (x') of the three orthogonally oriented accelerometer devices at step 696, a sub-surface voltage data point ($V_{y'm}$) by the second (y') of the three orthogonally oriented accelerometer devices at step 697, and a sub-surface voltage data point ($V_{z'm}$) by the third (z') of the three orthogonally oriented accelerometer devices at step 698. As it is acquiring said data points, the pre-programmed micro-control unit processor 118 from the MWD tool 109 is retrieving at 699 from the memory resource 117 the stored $V_{x'b}$, $V_{y'b}$, $V_{z'b}$, $S_{x'}$, $S_{y'}$, $S_{z'}$, cos(x',x), cos(y',y), and cos(z',z). For every retrieved temperature data point (t), a sub-surface voltage data points ($V_{x'm}$, ($V_{y'm}$, and $V_{y'm}$) the pre-programmed micro-control unit processor 118 begins computing at 700 an accuracy gravity coefficient for the three orthogonally oriented accelerometer devices, using the acquired t, $V_{x'm}$, $V_{x'm}$, $V_{x'm}$ and the retrieved $V_{x'b}$, $V_{y'b}$, $V_{z'b}$, $S_{x'}$, $S_{y'}$, $S_{z'}$, cos(x',x), cos(y',y) according to the following pre-programmed expression in the micro-control unit processor:

$$\begin{bmatrix} AX(t) \\ AY(t) \\ AZ(t) \end{bmatrix} = \begin{bmatrix} \cos(x', x)(t) & \cos(x', y)(t) & \cos(x', z)(t) \\ \cos(y', x)(t) & \cos(y', y)(t) & \cos(y', z)(t) \\ \cos(z', x)(t) & \cos(z', z)(t) & \cos(z', z)(t) \end{bmatrix}^{-1} \begin{bmatrix} \frac{V_{x'm} - V_{x'b}(t)}{S_{x'}(t)} \\ \frac{V_{y'm} - V_{y'b}(t)}{S_{y'}(t)} \\ \frac{V_{z'm} - V_{z'b}(t)}{S_{z'}(t)} \end{bmatrix}. \quad (48)$$

The computation of the accuracy gravity coefficient for the three orthogonally oriented accelerometer devices repeats at 701 for every value of the acquired t, $V_{x'm}$, $V_{x'm}$, $V_{x'm}$ and that only occurs when the deployed drill string in a borehole stops. That means that steps 695 through 700 are repeated until said stoppage event occurs. Upon successfully reaching the end of the drilling process whereby the deployed drill string in a borehole stops the pre-programmed micro-control unit processor 118 begins storing at 702 to the memory resource 117, the computed accuracy gravity coefficients for the three orthogonally oriented accelerometer devices from the repeated steps. The method is then considered finalized when the stored accuracy gravity coefficients for the three orthogonally oriented accelerometer devices from the repeated steps are transmitted at 703 using the embedded telemetry device 112 to the above-surface memory resource 111 which also has its own telemetry device for receiving and sending information.

According to the preferred embodiment of the present invention, certain hardware, and software (including firmware) descriptions were detailed, merely as example embodiments and are not to limit the structure of implementation of the disclosed embodiments. For example, although many internal, and external components of the pre-programmed micro-control unit processor 118 have been described, those with ordinary skills in the art will appreciate that such components and their interconnection are well known. Additionally, certain aspects of the disclosed invention may be embodied in software that is executed using one or more non-transitory computer readable memory devices in lieu of, or in addition to, the pre-programmed micro-control unit processor 118. Program aspects, algorithms, expressions, operations, and steps of the technology may be thought of as "products" or "articles of manufacture" typically in the form of executable code and/or associated data that is carried on, or embodied in, a type of machine readable medium. Tangible non-transitory "storage" type media and devices (i.e., memory resources) include any or all memory or other storage for the computers, process or the like, or associated modules thereof such as various semiconductor memories, tape drives, disk drives, optical or magnetic disks, and the like which may provide storage at any time for the software programming.

Unless specifically stated otherwise, terms such as "computing," "performing," "inputting," "acquiring," "calibrating," "repeating," "outputting", "initializing," "deploying," "using," "extracting," "retrieving," "displaying," "storing," "executing," or "implementing" may refer to the action and processes of a micro control unit processor, computer system, non-transitory computer readable memory device, memory resource or other electronic device, that transforms data represented as physical (electronic, magnetic, or optical) quantities within some electrical device's storage, like memory resources, or non-transitory computer readable memory, into other data similarly represented as physical quantities within the storage, or in transmission or display devices.

As used herein, the term "computing" encompasses a wide variety of actions, including calculating, determining, processing, deriving, investigation, generating, look ups (e.g., looking up in a table, a database, or another data structure), ascertaining and the like. It may also include receiving (e.g., receiving information), accessing (e.g., accessing data in a memory) and the like. Also, "computing" may include resolving, selecting, choosing, establishing, and the like.

As used herein, "sub-surface" means beneath the top surface of any mass of land at any elevation or over a range of elevations, whether above, below or at sea level, and/or beneath the floor surface of any mass of water, whether above, below or at sea level.

The pre-programmed micro-control unit processor 118 computer program or code may be stored or encoded over some type of transmission medium. A memory resource includes any medium or mechanism for storing or transmitting information in a form readable by a machine, such as a computer ("machine" and "computer" may be used synonymously herein). As a non-limiting example, a memory resource may include a computer-readable storage medium (e.g., read only memory ("ROM"), random access memory ("RAM"), magnetic disk storage media, optical storage media, flash memory devices, etc.). A transmission medium may be twisted wire pairs, coaxial cable, optical fiber, or some other suitable wired or wireless transmission medium, for transmitting signals such as electrical, optical, acoustical, or other form of propagated signals (e.g., carrier waves, infrared signals, digital signals, etc.)).

A micro-control unit processor as used herein, typically includes at least hardware capable of executing machine readable instructions, as well as the software for executing acts (typically machine-readable instructions) that produce a desired result. In addition, a computer system may include hybrids of hardware and software, as well as computer sub-systems.

Hardware generally includes at least processor-capable platforms, such as client-machines (also known as servers), and hand-held processing devices (for example smart phones, personal digital assistants (PDAs), or personal computing devices (PCDs)). Further, hardware may include any physical device that can store machine-readable instructions, such as memory or other data storage devices. Other forms of hardware include hardware sub-systems, including transfer devices such as modems, modem cards, ports, and port cards, for example.

Software includes any machine code stored in any memory medium, such as RAM or ROM, and machine code stored on other devices (such as non-transitory computer readable media like external hard drives, or flash memory, for example). Software may include source or object code, encompassing any set of instructions capable of being executed in a client machine, server machine, remote desktop, or terminal.

Combinations of software and hardware could also be used for providing enhanced functionality and performance for certain embodiments of the disclosed invention. One example is to directly manufacture software functions into a silicon chip. Accordingly, combinations of hardware and software are also included within the definition of a computer system and are thus envisioned by the invention as possible equivalent structures and equivalent methods.

Computer-readable mediums or memory resources further include passive data storage, such as a random-access memory (RAM) as well as semi-permanent data storage such as external hard drives, and external databases, for example. In addition, an embodiment of the invention may be embodied in the RAM of a computer to transform a standard computer into a new specific computing machine.

Data structures, data values, data points, or information values are defined organizations of data that may enable an embodiment of the invention. For example, a data point may provide an organization of data, or an organization of executable code. Data signals could be carried across non-transitory transmission mediums and stored and transported across various data structures, and, thus, may be used to transport an embodiment of the invention.

The micro-control unit processor 118 may be designed to work on any specific architecture or as a client, in a server-client configuration. For example, the pre-programmed algorithms of the micro-control unit processor 118 may also be executed on a high-performance computing system, which typically comprise the aggregation of multiple single computers, physically connected, or connected over local area networks, wide area networks, internets, hand-held and other portable and wireless devices.

The embedded memory resource 302 of the pre-programmed micro-control unit processor 118, memory resource 117 of the MWD tool 109, and the above-surface memory resource 111, may further comprise a database, or multiple databases having any standard or proprietary database software, such as Oracle, Microsoft Access, SyBase, or DBase II. The database may have fields, records, data, and other database elements that may be associated through database specific software to store all the required information or data from method 601. Additionally, data may be mapped. Mapping is the process of associating one data entry with another data entry. For example, the data contained in the location of a character file can be mapped to a field in a second table. The physical location of the database is not limiting, and the database may be distributed. For example, the database may exist remotely from the server, and run on a separate platform. Further, the database may be accessible across a local network, a wireless network of the Internet.

Furthermore, modules, features, attributes, methodologies, and other aspects can be implemented as software, hardware, firmware, or any combination thereof. Wherever a component of the invention is implemented as software, the component can be implemented as a standalone program, as part of a larger program, as a plurality of separate programs, as a statically or dynamically linked library, as a kernel loadable module, as a device driver, and/or in every and any other way known now or in the future to those of skill in the art of computer programming. Additionally, the invention is not limited to implementation in any specific operating system or environment.

Various terms as used herein are defined below. To the extent a term used in a claim is not defined below, it should be given the broadest possible definition persons in the pertinent art have given that term as reflected in at least one printed publication or issued patent.

As used herein, "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined Additionally, the flowcharts and block diagrams in the Figures ("FIG.") illustrate the architecture, functionality, and operation of possible implementations of method 601 according to various embodiments of the present disclosure. It should also be noted that, in some alternative implementations, the functions noted in the block may occur out of the order noted in the Figures. For examples, two blocks shown in succession may, in fact, be executed substantially concurrently, or the blocks may sometimes be executed in the reverse order, depending upon the functionality involved. It will also be noted that each block of the block diagrams and/or flowcharts illustration, and combinations of blocks in the block diagrams and/or flowchart illustration, can be implemented by special purpose hardware-based systems that perform the specified hardware functions or acts, or combinations of special purpose hardware and computer instructions.

While in the foregoing specification this disclosure has been described in relation to certain preferred embodiments thereof, and many details have been set forth for purpose of illustration, the invention is not to be unduly limited to the foregoing which has been set forth for illustrative purposes. On the contrary, a wide variety of modifications and alternative embodiments will be apparent to a person skilled in the art, without departing from the true scope of the invention, as defined in the claims set forth below. Additionally, it should be appreciated that structural features or method steps shown or described in any one embodiment herein can be used in other embodiments as well.

We claim:

1. A method of obtaining accuracy gravity coefficients for three orthogonally oriented accelerometer devices using, temperature errors, bias error coefficients, sensitivity error coefficients, and orthogonality error coefficients during measurement while drilling operations, comprising:

initializing a measuring while drilling tool being rotatable in 90-degree increments and having a pre-programmed micro-control unit processor to compute algorithmic expressions, a memory resource, a telemetry device, three orthogonally oriented accelerometer devices (x', y',z') each for acquiring upward and downward voltage data point, and a thermometer device;

acquiring, by the thermometer device, a temperature data point ($t_m$);

calibrating, by the pre-programmed micro-control unit processor, the acquired temperature data point from the thermometer device;

repeating the steps (n) of acquiring a temperature data point, and calibrating said acquired temperature data point, until a pre-programmed maximum allowable temperature data point ($t_{m_n}$) of the thermometer device has been reached;

computing, by the pre-programmed micro-control unit processor, temperature error coefficient from the repeated steps of acquiring a temperature data points;

storing to the memory resource by the pre-programmed micro-control unit processor, the computed temperature data points;

positioning, by inverting the measuring while drilling tool to an upward position, having a first (x') of the three orthogonally oriented accelerometer devices also oriented upward;

(1) acquiring, by the first (x') of the three orthogonally oriented accelerometer devices oriented upward (j) multiple (n) upward voltage data points (i), until the last acquired multiple (n) upward voltage data point ($i_n$) has repeated at least three times;

(2) computing, by the pre-programmed micro-control unit processor, an upward average voltage data point (M(x', j)) using the acquired multiple (n) upward voltage data points (i) from the first (x') of the three orthogonally oriented accelerometer devices oriented upward (j);

(3) storing to the memory resource by the pre-programmed micro-control unit processor, the computed upward average voltage data point (M(x',j));

(4) acquiring, by the second (y') of the three orthogonally oriented accelerometer devices having the first (x') of the three orthogonally oriented accelerometer devices oriented upward (j), multiple (n) upward voltage data points (i), until the last acquired multiple (n) upward voltage data point ($i_n$) has repeated at least three times;

(5) computing, by the pre-programmed micro-control unit processor, an upward average voltage data point (M(y', j)) using the acquired multiple (n) upward voltage data points (i) from the second (y') of the three orthogonally oriented accelerometer devices having the first (x') of the three orthogonally oriented accelerometer devices oriented upward (j);

(6) storing to the memory resource by the pre-programmed micro-control unit processor, the computed upward average voltage data point (M(y',j));

(7) acquiring, by the third (z') of the three orthogonally oriented accelerometer devices having the first (x') of the three orthogonally oriented accelerometer devices oriented upward (j), multiple (n) upward voltage data points (i), until the last acquired multiple (n) upward voltage data point ($i_n$) has repeated at least three times;

(8) computing, by the pre-programmed micro-control unit processor, an upward average voltage data point (M(z, j)) using the acquired multiple (n) upward voltage data points (i) from the third (z') of the three orthogonally oriented accelerometer devices having the first (x') of the three orthogonally oriented accelerometer devices oriented upward (j);

(9) storing to the memory resource by the pre-programmed micro-control unit processor, the computed upward average voltage data point (M(z',j));

rotating the measuring while drilling tool in the upward position, having a first (x') of the three orthogonally oriented accelerometer devices also oriented upward, to a first 90-degree position;

repeating the steps (1) through (9) wherein M(x',j), M(y', j), and M(z',j) has values of j that equal 4 through 6;

rotating the measuring while drilling tool in the upward position, having a first (x') of the three orthogonally oriented accelerometer devices also oriented upward, to a 180-degree position;

repeating the steps (1) through (9) wherein M(x',j), M(y', j), and M(z',j) has values of j that equal 7 through 9;

rotating the measuring while drilling tool in the upward position, having a first (x') of the three orthogonally oriented accelerometer devices also oriented upward, to a 270-degree position;

repeating the steps (1) through (9) wherein M(x',j), M(y', j), and M(z',j) has values of j that equal 10 through 12;

positioning, by inverting the measuring while drilling tool to a downward position, having the first (x') of the three orthogonally oriented accelerometer devices also oriented downward;

(10) acquiring, by the first (x') of the three orthogonally oriented accelerometer devices oriented downward (j) multiple (n) downward voltage data points (i), until the last acquired multiple (n) downward voltage data point ($i_n$) has repeated at least three times;

(11) computing, by the pre-programmed micro-control unit processor, a downward average voltage data point (M(x',j)) using the acquired multiple (n) downward voltage data points (i) from the first (x') of the three orthogonally oriented accelerometer devices oriented downward (j);

(12) storing to the memory resource by the pre-programmed micro-control unit processor, the computed downward average voltage data point (M(x',j));

(13) acquiring, by the second (y') of the three orthogonally oriented accelerometer devices having the first (x') of the three orthogonally oriented accelerometer devices oriented downward (j), multiple (n) downward voltage data points (i), until the last acquired multiple (n) downward voltage data point ($i_n$) has repeated at least three times;

(14) computing, by the pre-programmed micro-control unit processor, a downward average voltage data point (M(y',j)) using the acquired multiple (n) downward voltage data points (i) from the second (y') of the three orthogonally oriented accelerometer devices having the first (x') of the three orthogonally oriented accelerometer devices oriented downward (j);

(15) storing to the memory resource by the pre-programmed micro-control unit processor, the computed downward average voltage data point (M(y',j));

(16) acquiring, by the third (z') of the three orthogonally oriented accelerometer devices having the first (x') of the three orthogonally oriented accelerometer devices oriented downward (j), multiple (n) downward voltage data points (i), until the last acquired multiple (n) downward voltage data point ($i_n$) has repeated at least three times;

(17) computing, by the pre-programmed micro-control unit processor, a downward average voltage data point (M(z,j)) using the acquired multiple (n) downward voltage data points (i) from the third (z') of the three orthogonally oriented accelerometer devices having the first (x') of the three orthogonally oriented accelerometer devices oriented downward (j);

(18) storing to the memory resource by the pre-programmed micro-control unit processor, the computed downward average voltage data point (M(z',j));

rotating the measuring while drilling tool in the downward position, having a first (x') of the three orthogonally oriented accelerometer devices also oriented downward, to a first 90-degree position;

repeating the steps (10) through (18) wherein M(x',j), M(y',j), and M(z',j) has values of j that equal 16 through 18;

rotating the measuring while drilling tool in the downward position, having a first (x') of the three orthogonally oriented accelerometer devices also oriented downward, to a 180-degree position;

repeating the steps (10) through (18) wherein M(x',j), M(y',j), and M(z',j) has values of j that equal 19 through 21;

rotating the measuring while drilling tool in the downward position, having a first (x') of the three orthogonally oriented accelerometer devices also oriented downward, to a 270-degree position;

repeating the steps (10) through (18) wherein M(x',j), M(y',j), and M(z',j) has values of j that equal 22 through 24;

positioning, by inverting the measuring while drilling tool to an upward position, having a second (y') of the three orthogonally oriented accelerometer devices also oriented upward;

(19) acquiring, by the second (y') of the three orthogonally oriented accelerometer devices oriented upward (j) multiple (n) upward voltage data points (i), until the last acquired multiple (n) upward voltage data point ($i_n$) has repeated at least three times;

(20) computing, by the pre-programmed micro-control unit processor, an upward average voltage data point (M(y',j)) using the acquired multiple (n) upward voltage data points (i) from the second (y') of the three orthogonally oriented accelerometer devices oriented upward (j);

(21) storing to the memory resource by the pre-programmed micro-control unit processor, the computed upward average voltage data point (M(y',j));

(22) acquiring, by the first (x') of the three orthogonally oriented accelerometer devices having the second (y') of the three orthogonally oriented accelerometer devices oriented upward (j), multiple (n) upward voltage data points (i), until the last acquired multiple (n) upward voltage data point ($i_n$) has repeated at least three times;

(23) computing, by the pre-programmed micro-control unit processor, an upward average voltage data point (M(x',j)) using the acquired multiple (n) upward voltage data points (i) from the first (x') of the three orthogonally oriented accelerometer devices having the second (y') of the three orthogonally oriented accelerometer devices oriented upward (j);

(24) storing to the memory resource by the pre-programmed micro-control unit processor, the computed upward average voltage data point (M(x',j));

(25) acquiring, by the third (z') of the three orthogonally oriented accelerometer devices having the second (y') of the three orthogonally oriented accelerometer devices oriented upward (j), multiple (n) upward voltage data points (i), until the last acquired multiple (n) upward voltage data point ($i_n$) has repeated at least three times;

(26) computing, by the pre-programmed micro-control unit processor, an upward average voltage data point (M(z',j)) using the acquired multiple (n) upward voltage data points (i) from the third (z') of the three orthogonally oriented accelerometer devices having the second (y) of the three orthogonally oriented accelerometer devices oriented upward (j), in accordance with the following pre-programmed expression:

(27) storing to the memory resource by the pre-programmed micro-control unit processor, the computed upward average voltage data point (M(z',j));

rotating the measuring while drilling tool in the upward position, having a second (y') of the three orthogonally oriented accelerometer devices also oriented upward, to a first 90-degree position;

repeating the steps (19) through (27) wherein M(y',j), M(x',j), and M(z',j) has values of j that equal 4 through 6;

rotating the measuring while drilling tool in the upward position, having a second (y') of the three orthogonally oriented accelerometer devices also oriented upward, to a 180-degree position;

repeating the steps (19) through (27) wherein M(y',j), M(x',j), and M(z',j) has values of j that equal 7 through 9;

rotating the measuring while drilling tool in the upward position, having a second (y') of the three orthogonally oriented accelerometer devices also oriented upward, to a 270-degree position;

repeating the steps (19) through (27) wherein M(y',j), M(x',j), and M(z',j) has values of j that equal 10 through 12;

positioning, by inverting the measuring while drilling tool to a downward position, having the second (y') of the three orthogonally oriented accelerometer devices also oriented downward;

(28) acquiring, by the second (y') of the three orthogonally oriented accelerometer devices oriented downward (j) multiple (n) downward voltage data points (i), until the last acquired multiple (n) downward voltage data point ($i_n$) has repeated at least three times;

(29) computing, by the pre-programmed micro-control unit processor, a downward average voltage data point (M(y',j)) using the acquired multiple (n) downward voltage data points (i) from the second (y') of the three orthogonally oriented accelerometer devices oriented downward (j);

(30) storing to the memory resource by the pre-programmed micro-control unit processor, the computed downward average voltage data point (M(y',j));

(31) acquiring, by the first (x') of the three orthogonally oriented accelerometer devices having the second (y') of the three orthogonally oriented accelerometer devices oriented downward (j), multiple (n) downward voltage data points (i), until the last acquired multiple (n) downward voltage data point ($i_n$) has repeated at least three times;

(32) computing, by the pre-programmed micro-control unit processor, a downward average voltage data point (M(z',j)) using the acquired multiple (n) downward voltage data points (i) from the first (x') of the three orthogonally oriented accelerometer devices having the second (y') of the three orthogonally oriented accelerometer devices oriented downward (j);

(33) storing to the memory resource by the pre-programmed micro-control unit processor, the computed downward average voltage data point (M(x',j));

(34) acquiring, by the third (z') of the three orthogonally oriented accelerometer devices having the second (y') of the three orthogonally oriented accelerometer devices oriented downward (j), multiple (n) downward voltage data points (i), until the last acquired multiple (n) downward voltage data point ($i_n$) has repeated at least three times;

(35) computing, by the pre-programmed micro-control unit processor, a downward average voltage data point (M(z,j)) using the acquired multiple (n) downward voltage data points (i) from the third (z') of the three orthogonally oriented accelerometer devices having the second (y') of the three orthogonally oriented accelerometer devices oriented downward (j);

(36) storing to the memory resource by the pre-programmed micro-control unit processor, the computed downward average voltage data point (M(z',j));

rotating the measuring while drilling tool in the downward position, having a second (y') of the three orthogonally oriented accelerometer devices also oriented downward, to a first 90-degree position;

repeating the steps (28) through (36) wherein M(y',j), M(x',j), and M(z',j) has values of j that equal 16 through 18;

rotating the measuring while drilling tool in the downward position, having a second (y') of the three orthogonally oriented accelerometer devices also oriented downward, to a 180-degree position;

repeating the steps (28) through (36) wherein M(y',j), M(x',j), and M(z',j) has values of j that equal 19 through 21;

rotating the measuring while drilling tool in the downward position, having a second (y') of the three orthogonally oriented accelerometer devices also oriented downward, to a 270-degree position;

repeating the steps (28) through (36) wherein M(y',j), M(x',j), and M(z',j) has values of j that equal 22 through 24;

positioning, by inverting the measuring while drilling tool to an upward position, having a third (z') of the three orthogonally oriented accelerometer devices also oriented upward;

(37) acquiring, by the third (z') of the three orthogonally oriented accelerometer devices oriented upward (j) multiple (n) upward voltage data points (i), until the last acquired multiple (n) upward voltage data point ($i_n$) has repeated at least three times;

(38) computing, by the pre-programmed micro-control unit processor, an upward average voltage data point (M(z',j)) using the acquired multiple (n) upward voltage data points (i) from the third (z') of the three orthogonally oriented accelerometer devices oriented upward (j);

(39) storing to the memory resource by the pre-programmed micro-control unit processor, the computed upward average voltage data point (M(z',j));

(40) acquiring, by the second (y') of the three orthogonally oriented accelerometer devices having the third (z') of the three orthogonally oriented accelerometer devices oriented upward (j), multiple (n) upward voltage data points (i), until the last acquired multiple (n) upward voltage data point ($i_n$) has repeated at least three times;

(41) computing, by the pre-programmed micro-control unit processor, an upward average voltage data point (M(y',j)) using the acquired multiple (n) upward voltage data points (i) from the second (y') of the three orthogonally oriented accelerometer devices having the third (z') of the three orthogonally oriented accelerometer devices oriented upward (j);

(42) storing to the memory resource by the pre-programmed micro-control unit processor, the computed upward average voltage data point (M(y',j));

(43) acquiring, by the first (x') of the three orthogonally oriented accelerometer devices having the third (z') of the three orthogonally oriented accelerometer devices oriented upward (j), multiple (n) upward voltage data points (i), until the last acquired multiple (n) upward voltage data point ($i_n$) has repeated at least three times;

(44) computing, by the pre-programmed micro-control unit processor, an upward average voltage data point (M(x',j)) using the acquired multiple (n) upward voltage data points (i) from the first (x') of the three orthogonally oriented accelerometer devices having the third (z') of the three orthogonally oriented accelerometer devices oriented upward (j);

(45) storing to the memory resource by the pre-programmed micro-control unit processor, the computed upward average voltage data point (M(x',j));

rotating the measuring while drilling tool in the upward position, having a third (z') of the three orthogonally oriented accelerometer devices also oriented upward, to a first 90-degree position;

repeating the steps (37) through (45) wherein M(z',j), M(y',j), and M(x',j) has values of j that equal 4 through 6;

rotating the measuring while drilling tool in the upward position, having a third (z') of the three orthogonally oriented accelerometer devices also oriented upward, to a 180-degree position;

repeating the steps (37) through (45) wherein M(z',j), M(y',j), and M(x',j) has values of j that equal 7 through 9;

rotating the measuring while drilling tool in the upward position, having a third (z') of the three orthogonally oriented accelerometer devices also oriented upward, to a 270-degree position;

repeating the steps (37) through (45) wherein M(z',j), M(y',j), and M(x',j) has values of j that equal 10 through 12;

positioning, by inverting the measuring while drilling tool to a downward position, having the third (z') of the three orthogonally oriented accelerometer devices also oriented downward;

(46) acquiring, by the third (z') of the three orthogonally oriented accelerometer devices oriented downward (j) multiple (n) downward voltage data points (i), until the last acquired multiple (n) downward voltage data point ($i_n$) has repeated at least three times;

(47) computing, by the pre-programmed micro-control unit processor, a downward average voltage data point (M(z',j)) using the acquired multiple (n) downward voltage data points (i) from the third (z') of the three orthogonally oriented accelerometer devices oriented downward (j);

(48) storing to the memory resource by the pre-programmed micro-control unit processor, the computed downward average voltage data point (M(z',j));

(49) acquiring, by the second (y') of the three orthogonally oriented accelerometer devices having the third (z') of the three orthogonally oriented accelerometer devices oriented downward (j), multiple (n) downward voltage data points (i), until the last acquired multiple (n) downward voltage data point ($i_n$) has repeated at least three times;

(50) computing, by the pre-programmed micro-control unit processor, a downward average voltage data point (M(y',j)) using the acquired multiple (n) downward voltage data points (i) from the second (y') of the three orthogonally oriented accelerometer devices having the third (z') of the three orthogonally oriented accelerometer devices oriented downward (j);

(51) storing to the memory resource by the pre-programmed micro-control unit processor, the computed downward average voltage data point (M(y',j));

(52) acquiring, by the first (x') of the three orthogonally oriented accelerometer devices having the third (z') of the three orthogonally oriented accelerometer devices oriented downward (j), multiple (n) downward voltage data points (i), until the last acquired multiple (n) downward voltage data point ($i_n$) has repeated at least three times;

(53) computing, by the pre-programmed micro-control unit processor, a downward average voltage data point (M(x',j)) using the acquired multiple (n) downward voltage data points (i) from the first (x') of the three orthogonally oriented accelerometer devices having the third (z') of the three orthogonally oriented accelerometer devices oriented downward (j);

(54) storing to the memory resource by the pre-programmed micro-control unit processor, the computed downward average voltage data point (M(x',j));

rotating the measuring while drilling tool in the downward position, having a third (z') of the three orthogonally oriented accelerometer devices also oriented downward, to a first 90-degree position;

repeating the steps (46) through (54) wherein M(z',j), M(y',j), and M(x',j) has values of j that equal 16 through 18;

rotating the measuring while drilling tool in the downward position, having a third (z') of the three orthogonally oriented accelerometer devices also oriented downward, to a 180-degree position;

repeating the steps (46) through (54) wherein M(z',j), M(y',j), and M(x',j) has values of j that equal 19 through 21;

rotating the measuring while drilling tool in the downward position, having a third (z') of the three orthogonally oriented accelerometer devices also oriented downward, to a 270-degree position;

repeating the steps (46) through (54) wherein M(z',j), M(y',j), and M(x',j) has values of j that equal 22 through 24;

computing, by the pre-programmed micro-control unit processor, a first position data point for the first (x') of the three orthogonally oriented accelerometer devices when the first (x') of the three orthogonally oriented accelerometer devices is oriented upward;

storing to the memory resource by the pre-programmed micro-control unit processor, the computed first position data point from the first (x') of the three orthogonally oriented accelerometer devices when said first (x') of the three orthogonally oriented accelerometer devices is oriented upward;

computing, by the pre-programmed micro-control unit processor, a first position data point for the second (y') of the three orthogonally oriented accelerometer devices when the first (x') of the three orthogonally oriented accelerometer devices is oriented upward;

storing to the memory resource by the pre-programmed micro-control unit processor, the computed first position data point from the second (y') of the three orthogonally oriented accelerometer devices when the first (x') of the three orthogonally oriented accelerometer devices is oriented upward;

computing, by the pre-programmed micro-control unit processor, a first position data point for the third (z') of the three orthogonally oriented accelerometer devices when the first (x') of the three orthogonally oriented accelerometer devices is oriented upward;

storing to the memory resource by the pre-programmed micro-control unit processor, the computed first position data point from the third (z') of the three orthogonally oriented accelerometer devices when the first (z') of the three orthogonally oriented accelerometer devices is oriented upward;

computing, by the pre-programmed micro-control unit processor, a second position data point for the first (x') of the three orthogonally oriented accelerometer devices when the first (x') of the three orthogonally oriented accelerometer devices is oriented downward;

storing to the memory resource by the pre-programmed micro-control unit processor, the computed second position data point from the first (x') of the three orthogonally oriented accelerometer devices when said first (x') of the three orthogonally oriented accelerometer devices is oriented downward;

computing, by the pre-programmed micro-control unit processor, a second position data point for the second (y') of the three orthogonally oriented accelerometer devices when the first (x') of the three orthogonally oriented accelerometer devices is oriented downward;

storing to the memory resource by the pre-programmed micro-control unit processor, the computed second position data point from the second (y') of the three orthogonally oriented accelerometer devices when the first (x') of the three orthogonally oriented accelerometer devices is oriented downward;

computing, by the pre-programmed micro-control unit processor, a second position data point for the third (z') of the three orthogonally oriented accelerometer devices when the first (x') of the three orthogonally oriented accelerometer devices is oriented downward;

storing to the memory resource by the pre-programmed micro-control unit processor, the computed second position data point from the third (z') of the three orthogonally oriented accelerometer devices when the first (x') of the three orthogonally oriented accelerometer devices is oriented downward;

computing, by the pre-programmed micro-control unit processor, a third position data point for the first (x') of the three orthogonally oriented accelerometer devices when the second (y') of the three orthogonally oriented accelerometer devices is oriented upward;

storing to the memory resource by the pre-programmed micro-control unit processor, the computed third position data point from the first (x') of the three orthogonally oriented accelerometer devices when said second (y') of the three orthogonally oriented accelerometer devices is oriented upward;

computing, by the pre-programmed micro-control unit processor, a third position data point for the second (y') of the three orthogonally oriented accelerometer devices when the second (y') of the three orthogonally oriented accelerometer devices is oriented upward;

storing to the memory resource by the pre-programmed micro-control unit processor, the computed third position data point from the second (y') of the three orthogonally oriented accelerometer devices when the second (y') of the three orthogonally oriented accelerometer devices is oriented upward;

computing, by the pre-programmed micro-control unit processor, a third position data point for the third (z') of the three orthogonally oriented accelerometer devices when the second (y') of the three orthogonally oriented accelerometer devices is oriented upward;

storing to the memory resource by the pre-programmed micro-control unit processor, the computed third position data point from the second (y') of the three orthogonally oriented accelerometer devices when the third (z') of the three orthogonally oriented accelerometer devices is oriented upward;

computing, by the pre-programmed micro-control unit processor, a fourth position data point for the first (x') of the three orthogonally oriented accelerometer devices when the second (y') of the three orthogonally oriented accelerometer devices is oriented downward;

storing to the memory resource by the pre-programmed micro-control unit processor, the computed fourth position data point from the first (x') of the three orthogonally oriented accelerometer devices when said second (y') of the three orthogonally oriented accelerometer devices is oriented downward;

computing, by the pre-programmed micro-control unit processor, a fourth position data point for the second (y') of the three orthogonally oriented accelerometer devices when the second (y') of the three orthogonally oriented accelerometer devices is oriented downward;

storing to the memory resource by the pre-programmed micro-control unit processor, the computed fourth position data point from the second (y') of the three orthogonally oriented accelerometer devices when the second (y') of the three orthogonally oriented accelerometer devices is oriented downward;

computing, by the pre-programmed micro-control unit processor, a fourth position data point for the third (z') of the three orthogonally oriented accelerometer devices when the second (y') of the three orthogonally oriented accelerometer devices is oriented downward;

storing to the memory resource by the pre-programmed micro-control unit processor, the computed fourth position data point from the third (z') of the three orthogonally oriented accelerometer devices when the second (y') of the three orthogonally oriented accelerometer devices is oriented downward;

computing, by the pre-programmed micro-control unit processor, a fifth position data point for the first (x') of the three orthogonally oriented accelerometer devices when the third (z') of the three orthogonally oriented accelerometer devices is oriented upward;

storing to the memory resource by the pre-programmed micro-control unit processor, the computed fifth position data point from the first (x') of the three orthogonally oriented accelerometer devices when said third (z') of the three orthogonally oriented accelerometer devices is oriented upward;

computing, by the pre-programmed micro-control unit processor, a fifth position data point for the second (y') of the three orthogonally oriented accelerometer devices when the third (z') of the three orthogonally oriented accelerometer devices is oriented upward;

storing to the memory resource by the pre-programmed micro-control unit processor, the computed fifth position data point from the second (y') of the three orthogonally oriented accelerometer devices when the third (z') of the three orthogonally oriented accelerometer devices is oriented upward;

computing, by the pre-programmed micro-control unit processor, a fifth position data point for the third (z') of the three orthogonally oriented accelerometer devices when the third (z') of the three orthogonally oriented accelerometer devices is oriented upward;

storing to the memory resource by the pre-programmed micro-control unit processor, the computed fifth position data point from the third (z') of the three orthogonally oriented accelerometer devices when the third (z') of the three orthogonally oriented accelerometer devices is oriented upward;

computing, by the pre-programmed micro-control unit processor, a sixth position data point for the first (x') of the three orthogonally oriented accelerometer devices when the third (z') of the three orthogonally oriented accelerometer devices is oriented downward;

storing to the memory resource by the pre-programmed micro-control unit processor, the computed sixth position data point from the first (x') of the three orthogonally oriented accelerometer devices when said third (z') of the three orthogonally oriented accelerometer devices is oriented downward;

computing, by the pre-programmed micro-control unit processor, a sixth position data point for the second (y') of the three orthogonally oriented accelerometer devices when the third (z') of the three orthogonally oriented accelerometer devices is oriented downward;

storing to the memory resource by the pre-programmed micro-control unit processor, the computed sixth position data point from the second (y') of the three orthogonally oriented accelerometer devices when the third (z') of the three orthogonally oriented accelerometer devices is oriented downward;

computing, by the pre-programmed micro-control unit processor, a sixth position data point for the third (z') of the three orthogonally oriented accelerometer devices when the third (z') of the three orthogonally oriented accelerometer devices is oriented downward;

storing to the memory resource by the pre-programmed micro-control unit processor, the computed sixth position data point from the third (z') of the three orthogonally oriented accelerometer devices when the third (z') of the three orthogonally oriented accelerometer devices is oriented downward;

computing, by the pre-programmed micro-control unit processor, a bias upward and downward error coefficient ($V_{x'b}$) for the first (x') of the three orthogonally oriented accelerometer devices, using the stored first, second, third, fourth, fifth, and sixth position data point data points P(x', 1), P(x', 2), P(x', 3), P(x', 4), P(x', 5), and P(x', 6);

storing to the memory resource by the pre-programmed micro-control unit processor, the computed bias upward and downward error coefficient ($V_{x'b}$) from the first (x') of the of the three orthogonally oriented accelerometer devices;

computing, by the pre-programmed micro-control unit processor, a bias upward and downward error coefficient ($V_{y'b}$) for the second (y') of the three orthogonally oriented accelerometer devices, using the stored first, second, third, fourth, fifth, and sixth position data point data points P(y', 1), P(y', 2), P(y', 3), P(y', 4), P(y', 5), and P(y', 6);

storing to the memory resource by the pre-programmed micro-control unit processor, the computed bias upward and downward error coefficient ($V_{y'b}$) from the second (y') of the of the three orthogonally oriented accelerometer devices;

computing, by the pre-programmed micro-control unit processor, a bias upward and downward error coefficient ($V_{z'b}$) for the third (z') of the three orthogonally oriented accelerometer devices, using the stored first, second, third, fourth, fifth, and sixth position data point data points P(z',1), P(z', 2), P(z', 3), P(z', 4), P(z', 5), and P(z', 6);

storing to the memory resource by the pre-programmed micro-control unit processor, the computed bias upward and downward error coefficient ($V_{z'b}$) from the third (z') of the of the three orthogonally oriented accelerometer devices;

computing, by the pre-programmed micro-control unit processor, an upward and downward sensitivity error coefficient ($S_{x'x}$) for the first (x') of the three orthogonally oriented accelerometer devices, using the stored first position data point when the first (x') of the three orthogonally oriented accelerometer devices is oriented upward (P(x',1)), using the second position data point when the first (x') of the three orthogonally oriented accelerometer devices is oriented downward (P(x', 2)), and a local gravity force data point (g) acquired by the first (x') of the three orthogonally oriented accelerometer devices;

storing to the memory resource by the pre-programmed micro-control unit processor, the computed upward and downward sensitivity error coefficient ($S_{x'x}$) from the first (x') of the of the three orthogonally oriented accelerometer devices when the first (x') of the three orthogonally oriented accelerometer devices is oriented upward and downward;

computing, by the pre-programmed micro-control unit processor, an upward and downward sensitivity error coefficient ($S_{y'x}$) for the second (y') of the three orthogonally oriented accelerometer devices, using the first position data point when the first (x') of the three orthogonally oriented accelerometer devices is oriented upward (P(y', 1)), using the second position data point when the first (x') of the three orthogonally oriented accelerometer devices is oriented downward (P(y', 2)), and a local gravity force data point (g) acquired by the second (y') of the three orthogonally oriented accelerometer devices;

storing to the memory resource by the pre-programmed micro-control unit processor, the computed upward and downward sensitivity error coefficient ($S_{y'x}$) from the second (y') of the of the three orthogonally oriented accelerometer devices when the first (x') of the three orthogonally oriented accelerometer devices is oriented upward and downward;

computing, by the pre-programmed micro-control unit processor, an upward and downward sensitivity error coefficient ($S_{z'x}$) for the third (z') of the three orthogonally oriented accelerometer devices, using the first position data point when the first (x') of the three orthogonally oriented accelerometer devices is oriented upward (P(z',1)), using the stored second position data point when the first (x') of the three orthogonally oriented accelerometer devices is oriented downward (P(z', 2)), and a local gravity force data point (g) acquired by the third (z') of the three orthogonally oriented accelerometer devices;

storing to the memory resource by the pre-programmed micro-control unit processor, the computed upward and downward sensitivity error coefficient ($S_{z'x}$) from the third (z') of the of the three orthogonally oriented accelerometer devices when the first (x') of the three orthogonally oriented accelerometer devices is oriented upward and downward;

computing, by the pre-programmed micro-control unit processor, an upward and downward sensitivity error coefficient ($S_{x'y}$) for the first (x') of the three orthogonally oriented accelerometer devices, using the stored third position data point when the second (y') of the three orthogonally oriented accelerometer devices is oriented upward (P(x', 3)), using the stored fourth position data point when the second (y') of the three orthogonally oriented accelerometer devices is oriented downward (P(x', 4)), and a local gravity force data point (g) acquired by the first (x') of the three orthogonally oriented accelerometer devices;

storing to the memory resource by the pre-programmed micro-control unit processor, the computed upward and downward sensitivity error coefficient ($S_{x'y}$) from the first (x') of the of the three orthogonally oriented accelerometer devices when the second (y') of the three orthogonally oriented accelerometer devices is oriented upward and downward;

computing, by the pre-programmed micro-control unit processor, an upward and downward sensitivity error coefficient ($S_{y'y}$) for the second (y') of the three orthogonally oriented accelerometer devices, using the stored third position data point when the second (y') of the three orthogonally oriented accelerometer devices is oriented upward (P(y', 3)), using the fourth position data point when the second (y') of the three orthogonally oriented accelerometer devices is oriented downward (P(y', 4)), and a local gravity force data point (g) acquired by the second (y') of the three orthogonally oriented accelerometer devices;

storing to the memory resource by the pre-programmed micro-control unit processor, the computed upward and downward sensitivity error coefficient ($S_{y'y}$) from the second (y') of the of the three orthogonally oriented accelerometer devices when the second (y') of the three orthogonally oriented accelerometer devices is oriented upward and downward;

computing, by the pre-programmed micro-control unit processor, an upward and downward sensitivity error coefficient ($S_{z'y}$) for the third (z') of the three orthogonally oriented accelerometer devices, using the stored third position data point (y') of the three orthogonally oriented accelerometer devices is oriented upward (P(z', 3)), using the stored fourth position data point when the second (y') of the three orthogonally oriented accelerometer devices is oriented downward (P(z', 4)), and a local gravity force data point (g) acquired by the third (z') of the three orthogonally oriented accelerometer devices;

storing to the memory resource by the pre-programmed micro-control unit processor, the computed upward and downward sensitivity error coefficient ($S_{z'y}$) from the third (z') of the of the three orthogonally oriented accelerometer devices when the second (y') of the three orthogonally oriented accelerometer devices is oriented upward and downward;

computing, by the pre-programmed micro-control unit processor, an upward and downward sensitivity error coefficient ($S_{xz}$) for the first (x') of the three orthogonally oriented accelerometer devices, using the stored fifth position data point when the third (z') of the three orthogonally oriented accelerometer devices is oriented upward (P(x', 5)), using the stored sixth position data point when the third (z') of the three orthogonally oriented accelerometer devices is oriented downward (P(x', 6)), and a local gravity force data point (g) acquired by the first (x') of the three orthogonally oriented accelerometer devices;

storing to the memory resource by the pre-programmed micro-control unit processor, the computed upward and downward sensitivity error coefficient ($S_{x'z}$) from the first (x') of the of the three orthogonally oriented accelerometer devices when the third (z') of the three orthogonally oriented accelerometer devices is oriented upward and downward;

computing, by the pre-programmed micro-control unit processor, an upward and downward sensitivity error coefficient ($S_{yz}$) for the second (y') of the three orthogonally oriented accelerometer devices, using the stored fifth position data point when the third (z') of the three orthogonally oriented accelerometer devices is oriented upward (P(y', 5)), using the stored sixth position data point when the third (z') of the three orthogonally oriented accelerometer devices is oriented downward (P(y', 6)), and a local gravity force data point (g) acquired by the second (y') of the three orthogonally oriented accelerometer devices;

storing to the memory resource by the pre-programmed micro-control unit processor, the computed upward and downward sensitivity error coefficient ($S_{y'z}$) from the second (y') of the of the three orthogonally oriented accelerometer devices when the third (z') of the three orthogonally oriented accelerometer devices is oriented upward and downward;

computing, by the pre-programmed micro-control unit processor, an upward and downward sensitivity error coefficient ($S_{z'z}$) for the third (z') of the three orthogonally oriented accelerometer devices, using the stored fifth position data point when the third (z') of the three orthogonally oriented accelerometer devices is oriented upward (P(z', 5)), using the stored sixth position data point when the third (z') of the three orthogonally oriented accelerometer devices is oriented downward (P(z', 6)), and a local gravity force data point (g) acquired by the third (z') of the three orthogonally oriented accelerometer devices;

storing to the memory resource by the pre-programmed micro-control unit processor, the computed upward and downward sensitivity error coefficient ($S_{z'z}$) from the third (z') of the of the three orthogonally oriented accelerometer devices when the third (z') of the three orthogonally oriented accelerometer devices is oriented upward and downward;

computing, by the pre-programmed micro-control unit processor, an average upward and downward sensitivity error coefficient for the first (x') of the of the three orthogonally oriented accelerometer devices using the stored upward and downward sensitivity error coefficient ($S_{x'x}$) from the first (x') of the of the three orthogonally oriented accelerometer devices when the first (x') of the three orthogonally oriented accelerometer devices is oriented upward and downward, the stored upward and downward sensitivity error coefficient ($S_{x'y}$) from the first (x') of the of the three orthogonally oriented accelerometer devices when the second (y') of the three orthogonally oriented accelerometer devices is oriented upward and downward, and the stored upward and downward sensitivity error coefficient ($S_{x'z}$) from the first (x') of the of the three orthogonally oriented accelerometer devices when the third (z') of the three orthogonally oriented accelerometer devices is oriented upward and downward;

storing to the memory resource by the pre-programmed micro-control unit processor, the computed average upward and downward sensitivity error coefficient for the first (x') of the of the three orthogonally oriented accelerometer devices;

computing, by the pre-programmed micro-control unit processor, an average upward and downward sensitivity error coefficient for the second (y') of the of the three orthogonally oriented accelerometer devices using the stored upward and downward sensitivity error coefficient ($S_{y'x}$) from the first (x') of the of the three orthogonally oriented accelerometer devices when the first (x') of the three orthogonally oriented accelerometer devices is oriented upward and downward, the stored upward and downward sensitivity error coefficient ($S_{y'y}$) from the second (y') of the of the three orthogonally oriented accelerometer devices when the second (y') of the three orthogonally oriented accelerometer devices is oriented upward and downward, and the stored upward and downward sensitivity error coefficient ($S_{y'z}$) from the second (y') of the of the three orthogonally oriented accelerometer devices when the third (z') of the three orthogonally oriented accelerometer devices is oriented upward and downward;

storing to the memory resource by the pre-programmed micro-control unit processor, the computed average upward and downward sensitivity error coefficient for the second (y') of the of the three orthogonally oriented accelerometer devices;

computing, by the pre-programmed micro-control unit processor, an average upward and downward sensitivity error coefficient for the third (z') of the of the three orthogonally oriented accelerometer devices using the stored upward and downward sensitivity error coefficient ($S_{z'x}$) from the third (z') of the of the three orthogonally oriented accelerometer devices when the first (x') of the three orthogonally oriented accelerometer devices is oriented upward and downward, the stored upward and downward sensitivity error coefficient ($S_{z'y}$) from the third (z') of the of the three orthogonally oriented accelerometer devices when the second (y') of the three orthogonally oriented accelerometer devices is oriented upward and downward, and the stored upward and downward sensitivity error coefficient ($S_{z'z}$) from the third (z') of the of the three orthogonally oriented accelerometer devices when the third (z') of the three orthogonally oriented accelerometer devices is oriented upward and downward;

storing to the memory resource by the pre-programmed micro-control unit processor, the computed average upward and downward sensitivity error coefficient for the third (z') of the of the three orthogonally oriented accelerometer devices;

computing, by the pre-programmed micro-control unit processor, an orthogonality error coefficient for the first (x') of the of the three orthogonally oriented accelerometer devices;

storing to the memory resource by the pre-programmed micro-control unit processor, the computed orthogonality error coefficient for the first (x') of the of the three orthogonally oriented accelerometer devices;

computing, by the pre-programmed micro-control unit processor, an orthogonality error coefficient for the second (y') of the of the three orthogonally oriented accelerometer devices;

storing to the memory resource by the pre-programmed micro-control unit processor, the computed orthogonality error coefficient for the second (y') of the of the three orthogonally oriented accelerometer devices;

computing, by the pre-programmed micro-control unit processor, an orthogonality error coefficient for the third (z') of the of the three orthogonally oriented accelerometer devices;

storing to the memory resource by the pre-programmed micro-control unit processor, the computed orthogonality error coefficient for the third (z') of the of the three orthogonally oriented accelerometer devices;

deploying a borehole string in a borehole, the borehole string including the downhole component, the downhole component having the measuring while drilling tool being rotatable in 90-degree increments and having the pre-programmed micro-control unit processor to compute algorithmic expressions, the memory resource, the telemetry device, the three orthogonally oriented accelerometer devices (x',y',z') each for acquiring upward and downward voltage data point, and the thermometer device;

acquiring, by the thermometer device, a temperature data point (t);

acquiring, by the first (x') of the three orthogonally oriented accelerometer devices a sub-surface voltage data point ($V_{x'm}$);

acquiring, by the second (y') of the three orthogonally oriented accelerometer devices a sub-surface voltage data point ($V_{y'm}$);

acquiring, by the third (z') of the three orthogonally oriented accelerometer devices a sub-surface voltage data point ($V_{z'm}$);

retrieving, from the memory resource by the pre-programmed micro-control unit processor, the stored $V_{x'b}$, $V_{y'b}$, $V_{z'b}$, $S_x$, $S_y$, $S_z$, cos(x',x), cos(y',y), and cos(z', z);

computing, by the pre-programmed micro-control unit processor, an accuracy gravity coefficient for the three orthogonally oriented accelerometer devices, using the acquired t, $V_{x'm}$, $V_{x'm}$, $V_{x'm}$ and the retrieved $V_{x'b}$, $V_{y'b}$, $V_{z'b}$, $S_x$, $S_y$, $S_z$, cos(x',x), cos(y',y);

repeating the steps of acquiring, by the thermometer device, a temperature data point (t), acquiring, by the first (x') of the three orthogonally oriented accelerometer devices a sub-surface voltage data point ($V_{x'm}$), acquiring, by the second (y') of the three orthogonally oriented accelerometer devices a sub-surface voltage data point ($V_{y'm}$), acquiring, by the third (z') of the three orthogonally oriented accelerometer devices a sub-surface voltage data point ($V_{z'm}$), and computing, by the pre-programmed micro-control unit processor, an accuracy gravity coefficient for the three orthogonally oriented accelerometer devices, until the deployed borehole string in a borehole stops;

storing to the memory resource by the pre-programmed micro-control unit processor, the computed accuracy gravity coefficients for the three orthogonally oriented accelerometer devices from the repeated steps; and transmitting using the telemetry device of the downhole component the stored accuracy gravity coefficients for the three orthogonally oriented accelerometer devices from the repeated steps to an above-surface memory resource.

2. The method of claim 1, wherein the step of calibrating, by the pre-programmed micro-control unit processor, the acquired temperature data point from the thermometer device further comprises the following pre-programmed expression on the micro-control unit processor:

$$T_c(t_m)=c_0+c_1t_m+c_2t_m^2+\ldots+c_kt_m^k.$$

3. The method of claim 1, wherein the step of computing, by the pre-programmed micro-control unit processor, temperature error coefficient from the repeated steps of acquiring a temperature data points further comprises the following pre-programmed expression on the micro-control unit processor:

$$t_n=T_c(t_{mn}).$$

4. The method of claim 1, wherein in step (2) of computing, an upward average voltage data point (M(x',j)) using the acquired multiple (n) upward voltage data points (i) from the first (x') of the three orthogonally oriented accelerometer devices oriented upward (j), further comprises the following pre-programmed expression on the micro-control unit processor:

$$M(x', j) = \frac{\sum_{i=1}^{n} V(x', i)}{n},$$

Wherein, in step (5) of computing, an upward average voltage data point (M(y',j)) using the acquired multiple (n) upward voltage data points (i) from the second (y') of the three orthogonally oriented accelerometer devices having the first (x') of the three orthogonally oriented accelerometer devices oriented upward (j), further comprises the following pre-programmed expression on the micro-control unit processor:

$$M(y', j) = \frac{\sum_{i=1}^{n} V(y, i)}{n},$$

Wherein, in step (8) of computing, an upward average voltage data point (M(z,j)) using the acquired multiple (n) upward voltage data points (i) from the third (z') of the three orthogonally oriented accelerometer devices having the first (x') of the three orthogonally oriented accelerometer devices oriented upward (j), further comprises the following pre-programmed expression on the micro-control unit processor:

$$M(z', j) = \frac{\sum_{i=1}^{n} V(z', i)}{n},$$

Wherein, in step (11) of computing, a downward average voltage data point (M(x',j)) using the acquired multiple (n) downward voltage data points (i) from the first (x') of the three orthogonally oriented accelerometer devices oriented downward (j), further comprises the following pre-programmed expression on the micro-control unit processor:

$$M(x', j) = \frac{\sum_{i=1}^{n} V(x', i)}{n},$$

Wherein, in step (14) of computing, a downward average voltage data point (M(y',j)) using the acquired multiple (n) downward voltage data points (i) from the second (y') of the three orthogonally oriented accelerometer devices having the first (x') of the three orthogonally oriented accelerometer devices oriented downward (j), further comprises the following pre-programmed expression on the micro-control unit processor:

$$M(y', j) = \frac{\sum_{i=1}^{n} V(y', i)}{n},$$

Wherein, in step (17) of computing, a downward average voltage data point (M(z,j)) using the acquired multiple (n) downward voltage data points (i) from the third (z') of the three orthogonally oriented accelerometer devices having the first (x') of the three orthogonally oriented accelerometer devices oriented downward (j), further comprises the following pre-programmed expression on the micro-control unit processor:

$$M(z', j) = \frac{\sum_{i=1}^{n} V(z', i)}{n},$$

Wherein, in step (20) of computing, by the pre-programmed micro-control unit processor, an upward average voltage data point (M(y',j)) using the acquired multiple (n) upward voltage data points (i) from the second (y') of the three orthogonally oriented accelerometer devices oriented upward (j), further comprises the following pre-programmed expression on the micro-control unit processor:

$$M(y', j) = \frac{\sum_{i=1}^{n} V(y', i)}{n},$$

Wherein, in step (23) of computing, an upward average voltage data point (M(x',j)) using the acquired multiple (n) upward voltage data points (i) from the first (x') of the three orthogonally oriented accelerometer devices having the second (y') of the three orthogonally oriented accelerometer devices oriented upward (j), further comprises the following pre-programmed expression on the micro-control unit processor:

$$M(x', j) = \frac{\sum_{i=1}^{n} V(x', i)}{n},$$

Wherein, in step (26) of computing, an upward average voltage data point (M(z',j)) using the acquired multiple (n) upward voltage data points (i) from the third (z') of the three orthogonally oriented accelerometer devices having the second (y) of the three orthogonally oriented accelerometer devices oriented upward (j), further comprises the following pre-programmed expression on the micro-control unit processor:

$$M(z', j) = \frac{\sum_{i=1}^{n} V(z', i)}{n},$$

Wherein, in step (29) of computing, a downward average voltage data point (M(y',j)) using the acquired multiple (n) downward voltage data points (i) from the second (y') of the three orthogonally oriented accelerometer devices oriented downward (j), further comprises the following pre-programmed expression on the micro-control unit processor:

$$M(y', j) = \frac{\sum_{i=1}^{n} V(y', i)}{n},$$

Wherein, in step (32) of computing, a downward average voltage data point (M(z',j)) using the acquired multiple (n) downward voltage data points (i) from the first (x') of the three orthogonally oriented accelerometer devices having the second (y') of the three orthogonally oriented accelerometer devices oriented downward (j), further comprises the following pre-programmed expression on the micro-control unit processor:

$$M(x', j) = \frac{\sum_{i=1}^{n} V(x', i)}{n},$$

$$M(z, j)niz')y')j$$

M(z,j)niz')y')j wherein, in step (35) of computing, a downward average voltage data point ( ) using the acquired multiple ( ) downward voltage data points ( ) from the third (of the three orthogonally oriented accelerometer devices having the second (of the three orthogonally oriented accelerometer devices oriented downward ( ), further comprises the following pre-programmed expression on the micro-control unit processor:

$$M(z', j) = \frac{\sum_{i=1}^{n} V(z', i)}{n},$$

Wherein, in step (38) of computing, an upward average voltage data point (M(z',j)) using the acquired multiple (n) upward voltage data points (i) from the third (z') of the three orthogonally oriented accelerometer devices oriented upward (j), further comprises the following pre-programmed expression on the micro-control unit processor:

$$M(z', j) = \frac{\sum_{i=1}^{n} V(z', i)}{n}.$$

Wherein, in step (41) of computing, an upward average voltage data point (M(y',j)) using the acquired multiple (n) upward voltage data points (i) from the second (y') of the three orthogonally oriented accelerometer devices having the third (z') of the three orthogonally oriented accelerometer devices oriented upward (j), further comprises the following pre-programmed expression on the micro-control unit processor:

$$M(y', j) = \frac{\sum_{i=1}^{n} V(y', i)}{n},$$

Wherein, in step (44) of computing, an upward average voltage data point (M(x',j)) using the acquired multiple (n) upward voltage data points (i) from the first (x') of the three orthogonally oriented accelerometer devices having the third (z') of the three orthogonally oriented accelerometer devices oriented upward (j), further comprises the following pre-programmed expression on the micro-control unit processor:

$$M(x', j) = \frac{\sum_{i=1}^{n} V(x', i)}{n},$$

Wherein, in step (47) of computing, a downward average voltage data point (M(z',j)) using the acquired multiple (n) downward voltage data points (i) from the third (z') of the three orthogonally oriented accelerometer devices oriented downward (j), further comprises the following pre-programmed expression on the micro-control unit processor:

$$M(z', j) = \frac{\sum_{i=1}^{n} V(z', i)}{n},$$

Wherein, in step (50) of computing, a downward average voltage data point (M(y',j)) using the acquired multiple (n) downward voltage data points (i) from the second (y') of the three orthogonally oriented accelerometer devices having the third (z') of the three orthogonally oriented accelerometer devices oriented downward (j), further comprises the following pre-programmed expression on the micro-control unit processor:

$$M(y', j) = \frac{\sum_{i=1}^{n} V(y', i)}{n}, \text{ and}$$

Wherein, in step (53) of computing, a downward average voltage data point (M(x',j)) using the acquired multiple (n) downward voltage data points (i) from the first (x') of the three orthogonally oriented accelerometer devices having the third (z') of the three orthogonally oriented accelerometer devices oriented downward (j), further comprises the following pre-programmed expression on the micro-control unit processor:

$$M(x', j) = \frac{\sum_{i=1}^{n} V(x', i)}{n}.$$

5. The method of claim 1, wherein the step of computing, by the pre-programmed micro-control unit processor, a first position data point for the first (x') of the three orthogonally oriented accelerometer devices when the first (x') of the three orthogonally oriented accelerometer devices is oriented upward, further comprises the following pre-programmed expression on the micro-control unit processor:

$P(x',1)=\Sigma j=14M(x',j)/4,$ a first position data point for the second (y') of the three orthogonally oriented accelerometer devices when the first (x') of the three orthogonally oriented accelerometer devices is oriented upward, further comprises the following pre-programmed expression on the micro-control unit processor:

$P(V',1)=\Sigma j=14M(y',j)/4,$ a first position data point for the third (z') of the three orthogonally oriented accelerometer devices when the first (x') of the three orthogonally oriented accelerometer devices is oriented upward, further comprises the following pre-programmed expression on the micro-control unit processor:

$P(z',1)=\Sigma j=14M(z',j)/4,$ a second position data point for the first (x') of the three orthogonally oriented accelerometer devices when the first (x') of the three orthogonally oriented accelerometer devices is oriented downward, further comprises the following pre-programmed expression on the micro-control unit processor:

$P(x',2)=\Sigma j=58M(x',j)/4,$ a second position data point for the second (y') of the three orthogonally oriented accelerometer devices when the first (x') of the three orthogonally oriented accelerometer devices is oriented downward, computing, by the pre-programmed micro-control unit processor, a second position data point for the second (y') of the three orthogonally oriented accelerometer devices when the first (x') of the three orthogonally oriented accelerometer devices is oriented downward, further comprises the following pre-programmed expression on the micro-control unit processor:

$P(y',2)=\Sigma j=58M(y',j)/4,$ a second position data point for the third (z') of the three orthogonally oriented accelerometer devices when the first (x') of the three orthogonally oriented accelerometer devices is oriented downward, further comprises the following pre-programmed expression on the micro-control unit processor:

$P(z',2)=\Sigma j=58M(z',j)/4,$ a third position data point for the first (x') of the three orthogonally oriented accelerometer devices when the second (y') of the three orthogonally oriented accelerometer devices is oriented upward, further comprises the following pre-programmed expression on the micro-control unit processor:

$P(x',3)=\Sigma j=912M(x',j)/4,$ a third position data point for the second (y') of the three orthogonally oriented accelerometer devices when the second (y') of the three orthogonally oriented accelerometer devices is oriented upward, further comprises the following pre-programmed expression on the micro-control unit processor:

$P(y',3)=\Sigma j=912M(y',j)/4,$ a third position data point for the third (z') of the three orthogonally oriented accelerometer devices when the second (y') of the three orthogonally oriented accelerometer devices is oriented upward, further comprises the following pre-programmed expression on the micro-control unit processor:

$P(z',3)=\Sigma j=912M(z',j)/4,$ a fourth position data point for the first (x') of the three orthogonally oriented accelerometer devices when the second (y') of the three orthogonally oriented accelerometer devices is oriented downward, further comprises the following pre-programmed expression on the micro-control unit processor:

$P(x',4)=\Sigma j=1316M(x',j)/4,$ a fourth position data point for the second (y') of the three orthogonally oriented accelerometer devices when the second (y') of the three orthogonally oriented accelerometer devices is oriented downward, further comprises the following pre-programmed expression on the micro-control unit processor:

$$P(y',4)=\Sigma j=1316M(y',j)/4,$$

a fourth position data point for the third (z') of the three orthogonally oriented accelerometer devices when the second (y') of the three orthogonally oriented accelerometer devices is oriented downward, further comprises the following pre-programmed expression on the micro-control unit processor:

$$P(z',4)=\Sigma j=1316M(z',j)/4,$$

a fifth position data point for the first (x') of the three orthogonally oriented accelerometer devices when the third (z') of the three orthogonally oriented accelerometer devices is oriented upward, further comprises the following pre-programmed expression on the micro-control unit processor:

$$P(x',5)=\Sigma j=1720M(x',j)/4,$$

a fifth position data point for the second (y') of the three orthogonally oriented accelerometer devices when the third (z') of the three orthogonally oriented accelerometer devices is oriented upward, further comprises the following pre-programmed expression on the micro-control unit processor:

$$P(y',5)=\Sigma j=1720M(y',j)/4,$$

a fifth position data point for the third (z') of the three orthogonally oriented accelerometer devices when the third (z') of the three orthogonally oriented accelerometer devices is oriented upward, further comprises the following pre-programmed expression on the micro-control unit processor:

$$P(z',5)=\Sigma j=1720M(z',j)/4,$$

a sixth position data point for the first (x') of the three orthogonally oriented accelerometer devices when the third (z') of the three orthogonally oriented accelerometer devices is oriented downward, further comprises the following pre-programmed expression on the micro-control unit processor:

$$P(x',6)=\Sigma j=2124M(x',j)/4,$$

a sixth position data point for the second (y') of the three orthogonally oriented accelerometer devices when the third (z') of the three orthogonally oriented accelerometer devices is oriented downward, further comprises the following pre-programmed expression on the micro-control unit processor:

$$P(y',6)=\Sigma j=2124M(y',j)/4,$$

a sixth position data point for the third (z') of the three orthogonally oriented accelerometer devices when the third (z') of the three orthogonally oriented accelerometer devices is oriented downward, further comprises the following pre-programmed expression on the micro-control unit processor:

$$P(z',6)=\Sigma j=2124M(z',j)/4.$$

6. The method of claim 1, wherein, in the step of computing, by the pre-programmed micro-control unit processor, a bias upward and downward error coefficient ($V_{x'b}$) for the first (x') of the three orthogonally oriented accelerometer devices, using the stored first, second, third, fourth, fifth, and sixth position data point data points P(x',1), P(x', 2), P(x', 3), P(x', 4), P(x', 5), and P(x', 6), further comprises the following pre-programmed expression on the micro-control unit processor:

$$V_{x'b}=\frac{\sum_{i=1}^{6}P(x',i)}{6},$$

a bias upward and downward error coefficient ($V_{y'b}$) for the second (y') of the three orthogonally oriented accelerometer devices, using the stored first, second, third, fourth, fifth, and sixth position data point data points P(y', 1), P(y', 2), P(y', 3), P(y', 4), P(y', 5), and P(y', 6), further comprises the following pre-programmed expression on the micro-control unit processor:

$$V_{y'b}=\frac{\sum_{i=1}^{6}P(y',i)}{6},$$

and a bias upward and downward error coefficient ($V_{z'b}$) for the third (z') of the three orthogonally oriented accelerometer devices, using the stored first, second, third, fourth, fifth, and sixth position data point data points P(z', 1), P(z', 2), P(z', 3), P(z', 4), P(z', 5), and P(z', 6), further comprises the following pre-programmed expression on the micro-control unit processor:

$$V_{z'b}=\frac{\sum_{i=1}^{6}P(z',i)}{6}.$$

7. The method of claim 1, wherein the step of computing, by the pre-programmed micro-control unit processor, an upward and downward sensitivity error coefficient ($S_{x'x}$) for the first (x') of the three orthogonally oriented accelerometer devices, using the stored first position data point when the first (x') of the three orthogonally oriented accelerometer devices is oriented upward (P(x', 1)), using the second position data point when the first (x') of the three orthogonally oriented accelerometer devices is oriented downward (P(x', 2)), and a local gravity force data point (g) acquired by the first (x') of the three orthogonally oriented accelerometer devices, further comprises the following pre-programmed expression on the micro-control unit processor:

$$S_{x'x}=\frac{P(x',1)-P(x',2)}{2g},$$

an upward and downward sensitivity error coefficient ($S_{y'x}$) for the second (y') of the three orthogonally oriented accelerometer devices, using the first position data point when the first (x') of the three orthogonally oriented accelerometer devices is oriented upward (P(y', 1)), using the second position data point when the first (x') of the three orthogonally oriented accelerometer devices is oriented downward (P(y', 2)), and a local gravity force data point (g) acquired by the second (y') of the three orthogonally oriented accelerometer devices, further comprises the following pre-programmed expression on the micro-control unit processor:

$$S_{y'x} = \frac{P(y', 1) - P(y', 2)}{2g},$$

an upward and downward sensitivity error coefficient ($S_{z'x}$) for the third (z') of the three orthogonally oriented accelerometer devices, using the first position data point when the first (x') of the three orthogonally oriented accelerometer devices is oriented upward (P(z',1)), using the stored second position data point when the first (x') of the three orthogonally oriented accelerometer devices is oriented downward (P(z', 2)), and a local gravity force data point (g) acquired by the third (z') of the three orthogonally oriented accelerometer devices, further comprises the following pre-programmed expression on the micro-control unit processor:

$$S_{z'x} = \frac{P(z', 1) - P(z', 2)}{2g},$$

an upward and downward sensitivity error coefficient ($S_{x'y}$) for the first (x') of the three orthogonally oriented accelerometer devices, using the stored third position data point when the second (y') of the three orthogonally oriented accelerometer devices is oriented upward (P(x', 3)), using the stored fourth position data point when the second (y') of the three orthogonally oriented accelerometer devices is oriented downward (P(x', 4)), and a local gravity force data point (g) acquired by the first (x') of the three orthogonally oriented accelerometer devices, further comprises the following pre-programmed expression on the micro-control unit processor:

$$S_{x'y} = \frac{P(x', 3) - P(x', 4)}{2g},$$

an upward and downward sensitivity error coefficient ($S_{y'y}$) for the second (y') of the three orthogonally oriented accelerometer devices, using the stored third position data point when the second (y') of the three orthogonally oriented accelerometer devices is oriented upward (P(y', 3)), using the fourth position data point when the second (y') of the three orthogonally oriented accelerometer devices is oriented downward (P(y', 4)), and a local gravity force data point (g) acquired by the second (y') of the three orthogonally oriented accelerometer devices, further comprises the following pre-programmed expression on the micro-control unit processor:

$$S_{y'y} = \frac{P(y', 3) - P(y', 4)}{2g},$$

an upward and downward sensitivity error coefficient ($S_{z'y}$) for the third (z') of the three orthogonally oriented accelerometer devices, using the stored third position data point (y') of the three orthogonally oriented accelerometer devices is oriented upward (P(z', 3)), using the stored fourth position data point when the second (y') of the three orthogonally oriented accelerometer devices is oriented downward (P(z', 4)), and a local gravity force data point (g) acquired by the third (z') of the three orthogonally oriented accelerometer devices, further comprises the following pre-programmed expression on the micro-control unit processor:

$$S_{z'y} = \frac{P(z', 3) - P(z', 4)}{2g},$$

by the pre-programmed micro-control unit processor, an upward and downward sensitivity error coefficient ($S_{x'z}$) for the first (x') of the three orthogonally oriented accelerometer devices, using the stored fifth position data point when the third (z') of the three orthogonally oriented accelerometer devices is oriented upward (P(x',5)), using the stored sixth position data point when the third (z') of the three orthogonally oriented accelerometer devices is oriented downward (P(x', 6)), and a local gravity force data point (g) acquired by the first (x') of the three orthogonally oriented accelerometer devices, further comprises the following pre-programmed expression on the micro-control unit processor:

$$S_{x'z} = \frac{P(x', 5) - P(x', 6)}{2g},$$

an upward and downward sensitivity error coefficient ($S_{y'z}$) for the second (y') of the three orthogonally oriented accelerometer devices, using the stored fifth position data point when the third (z') of the three orthogonally oriented accelerometer devices is oriented upward (P(y', 5)), using the stored sixth position data point when the third (z') of the three orthogonally oriented accelerometer devices is oriented downward (P(y', 6)), and a local gravity force data point (g) acquired by the second (y') of the three orthogonally oriented accelerometer devices, further comprises the following pre-programmed expression on the micro-control unit processor:

$$S_{y'z} = \frac{P(y', 5) - P(y', 6)}{2g},$$

an upward and downward sensitivity error coefficient ($S_{z'z}$) for the third (z') of the three orthogonally oriented accelerometer devices, using the stored fifth position data point when the third (z') of the three orthogonally oriented accelerometer devices is oriented upward (P(z', 5)), using the stored sixth position data point when the third (z') of the three orthogonally oriented accelerometer devices is oriented downward (P(z', 6)), and a local gravity force data point (g) acquired by the third (z') of the three orthogonally oriented accelerometer devices, further comprises the following pre-programmed expression on the micro-control unit processor:

$$S_{z'z} = \frac{P(z', 5) - P(z', 6)}{2g},$$

an average upward and downward sensitivity error coefficient for the first (x') of the of the three orthogonally oriented accelerometer devices using the stored upward and downward sensitivity error coefficient ($S_{x'x}$) from the first (x') of the of the three orthogonally oriented accelerometer devices when the first (x') of the three orthogonally oriented accelerometer devices is oriented upward and downward, the stored upward and downward sensitivity error coefficient ($S_{x'y}$) from the first (x') of the of the three orthogonally oriented accelerometer devices when the second (y') of the three orthogonally oriented accelerometer devices is oriented upward and downward, and the stored upward and downward sensitivity error coefficient ($S_{x'z}$) from the first (x') of the of the three orthogonally oriented accelerometer devices when the third (z') of the three orthogonally oriented accelerometer devices is oriented upward and downward, further comprises the following pre-programmed expression on the micro-control unit processor:

$$S_x = \sqrt{(S_{x'x})^2 + (S_{x'y})^2 + (S_{x'z})^2},$$

an average upward and downward sensitivity error coefficient for the second (y') of the of the three orthogonally oriented accelerometer devices using the stored upward and downward sensitivity error coefficient ($S_{y'x}$) from the first (x') of the of the three orthogonally oriented accelerometer devices when the first (x') of the three orthogonally oriented accelerometer devices is oriented upward and downward, the stored upward and downward sensitivity error coefficient ($S_{y'y}$) from the second (y') of the of the three orthogonally oriented accelerometer devices when the second (y') of the three orthogonally oriented accelerometer devices is oriented upward and downward, and the stored upward and downward sensitivity error coefficient ($S_{y'z}$) from the second (y') of the of the three orthogonally oriented accelerometer devices when the third (z') of the three orthogonally oriented accelerometer devices is oriented upward and downward, further comprises the following pre-programmed expression on the micro-control unit processor:

$$S_y = \sqrt{(S_{y'x})^2 + (S_{y'y})^2 + (S_{y'z})^2}, \text{ and}$$

an average upward and downward sensitivity error coefficient for the third (z') of the of the three orthogonally oriented accelerometer devices using the stored upward and downward sensitivity error coefficient ($S_{z'x}$) from the third (z') of the of the three orthogonally oriented accelerometer devices when the first (x') of the three orthogonally oriented accelerometer devices is oriented upward and downward, the stored upward and downward sensitivity error coefficient ($S_{z'y}$) from the third (z') of the of the three orthogonally oriented accelerometer devices when the second (y') of the three orthogonally oriented accelerometer devices is oriented upward and downward, and the stored upward and downward sensitivity error coefficient ($S_{z'z}$) from the third (z') of the of the three orthogonally oriented accelerometer devices when the third (z') of the three orthogonally oriented accelerometer devices is oriented upward and downward, further comprises the following pre-programmed expression on the micro-control unit processor:

$$S_z = \sqrt{(S_{z'x})^2 + (S_{z'y})^2 + (S_{z'z})^2}.$$

8. The method of claim 1, wherein the step of computing, by the pre-programmed micro-control unit processor, an orthogonality error coefficient for the first (x') of the of the three orthogonally oriented accelerometer devices, further comprises the following pre-programmed expression on the micro-control unit processor:

$$\cos(x', x) = \frac{S_{x'x}}{S_{x'}},$$

an orthogonality error coefficient for the second (y') of the of the three orthogonally oriented accelerometer devices, further comprises the following pre-programmed expression on the micro-control unit processor:

$$\cos(y', y) = \frac{S_{y'y}}{S_{y'}},$$

and an orthogonality error coefficient for the third (z') of the of the three orthogonally oriented accelerometer devices, further comprises the following pre-programmed expression on the micro-control unit processor:

$$\cos(z', z) = \frac{S_{z'z}}{S_{z'}}.$$

9. The method of claim 1, wherein the step of computing, by the pre-programmed micro-control unit processor, an accuracy gravity coefficient for the three orthogonally oriented accelerometer devices, using the acquired t, $V_{x'm}$, $V_{x'm}$, $V_{x'm}$ and the retrieved $V_{x'b}$, $V_{y'b}$, $V_{z'b}$, $S_{x'}$, $S_{y'}$, $S_{z'}$, cos(x', x), cos(y',y), further comprises the following pre-programmed expression on the micro-control unit processor:

$$\begin{bmatrix} AX(t) \\ AY(t) \\ AZ(t) \end{bmatrix} = \begin{bmatrix} \cos(x', x)(t) & \cos(x', y)(t) & \cos(x', z)(t) \\ \cos(y', x)(t) & \cos(y', y)(t) & \cos(y', z)(t) \\ \cos(z', x)(t) & \cos(z', z)(t) & \cos(z', z)(t) \end{bmatrix}^{-1} \begin{bmatrix} \frac{V_{x'm} - V_{x'b}(t)}{s_{x'}(t)} \\ \frac{V_{y'm} - V_{y'b}(t)}{s_{y'}(t)} \\ \frac{V_{z'm} - V_{z'b}(t)}{s_{z'}(t)} \end{bmatrix}.$$

* * * * *